US007484466B2

(12) United States Patent
Kuki et al.

(10) Patent No.: US 7,484,466 B2
(45) Date of Patent: Feb. 3, 2009

(54) CLOTH HOLDING DEVICE

(75) Inventors: Masakazu Kuki, Ichinomiya (JP); Hiroshi Kitazawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 125 days.

(21) Appl. No.: 10/594,755

(22) PCT Filed: Jan. 25, 2005

(86) PCT No.: PCT/JP2005/000920

§ 371 (c)(1),
(2), (4) Date: Sep. 29, 2006

(87) PCT Pub. No.: WO2005/093148

PCT Pub. Date: Oct. 6, 2005

(65) Prior Publication Data

US 2008/0098940 A1 May 1, 2008

(30) Foreign Application Priority Data

Mar. 29, 2004 (JP) ..... 2004-096544

(51) Int. Cl.
*D05C 9/04* (2006.01)
*D05C 1/02* (2006.01)

(52) U.S. Cl. ..... 112/103; 38/102.2

(58) Field of Classification Search ..... 112/103, 112/470.14, 311, 475.18; 38/102.21, 102.91
See application file for complete search history.

(56) References Cited

U.S. PATENT DOCUMENTS

| | | | | |
|---|---|---|---|---|
| 4,079,529 | A * | 3/1978 | Jennen et al. | 38/102.2 |
| 4,475,300 | A * | 10/1984 | Ledenican | 40/600 |
| 4,487,196 | A * | 12/1984 | Murphy | 126/690 |
| 5,138,960 | A * | 8/1992 | Inteso | 112/103 |
| 5,353,725 | A | 10/1994 | Sakakibara | |
| 5,581,918 | A * | 12/1996 | Schilling et al. | 38/102.1 |
| 6,775,934 | B1 * | 8/2004 | Gallik et al. | 38/102.2 |

FOREIGN PATENT DOCUMENTS

| | | |
|---|---|---|
| JP | 56-10308 Y2 | 3/1981 |
| JP | 60-24293 Y2 | 7/1985 |
| JP | 63-28230 Y2 | 7/1988 |
| JP | A 05-179559 | 7/1993 |
| JP | A 11-181666 | 7/1999 |
| JP | A 2000-008264 | 1/2000 |
| JP | A 2002-078996 | 3/2002 |

* cited by examiner

*Primary Examiner*—Ismael Izaguirre
(74) *Attorney, Agent, or Firm*—Oliff & Berridge, PLC

(57) ABSTRACT

A cloth holding device including a support frame (11) made of magnetic material and a presser frame (12), clamping a workpiece cloth therebetween, including an attachment unit (13, 14) that attaches the presser frame (12) to the support frame (11) by magnetic attraction; and a positioning unit (12*c*) that positions the attachment unit (13, 14) to the presser frame (12).

12 Claims, 29 Drawing Sheets

CLOTH HOLDING DEVICE

TECHNICAL FIELD

The present invention relates to a cloth holding device that holds a workpiece cloth.

BACKGROUND ART

A conventional embroidery sewing machine generally employs an embroidery frame, having an outer frame and an inner frame fitted into the outer frame, as a cloth holding device that holds a sewing workpiece cloth in a stretched manner. The workpiece cloth is clamped between the outer frame and the inner frame fitted into the outer frame. The embroidery frame is attached to a carriage of a frame drive mechanism of the embroidery sewing machine and the frame drive mechanism feeds the cloth by driving the embroidery frame in the horizontal direction.

In sewing the workpiece cloth held by the cloth holding device, a sewing pattern cannot be sewn properly when the workpiece cloth is displaced from the original positioning rendered by the workpiece cloth holding device. Thus there is a need to reinforce the capacity of the cloth holding device to hold the workpiece cloth.

Such being the case, a cloth holding device providing increased cloth holding capacity is disclosed in JP-Y-S63-28230, for example. The cloth holding device is an embroidery frame comprising an outer frame provided with a plurality of magnets and an inner frame fitted into the outer frame. In such embroidery frames, the workpiece cloth is placed on the outer frame upper surface and the workpiece cloth is held by the outer frame by attaching a separate set of magnets to the aforementioned plurality of magnets over the workpiece cloth. Thereafter, by fitting the inner frame into the outer frame, the workpiece cloth is held between the outer frame and the inner frame.

DISCLOSURE OF THE INVENTION

In fitting the inner frame into the outer frame, the workpiece cloth may become displaced by the friction exerted on the workpiece cloth by the outer frame and the inner frame. Furthermore, it is difficult to partially release the hold of the workpiece cloth by the outer frame and the inner frame after the workpiece cloth is clamped by the outer frame and the inner frame being fitted with each other. Thus, it is difficult for the user to readily and reliably rearrange the hold of the workpiece cloth by displacing the workpiece cloth in desired amounts relative to the embroidery frame and at the same time stretching the workpiece cloth in order to position the workpiece cloth in the desired position with respect to the embroidery frame.

Also, when the separate set of magnets are attached to the magnets provided in the outer frame with the workpiece cloth placed on the upper surface of the outer frame, the magnets provided on the outer frame become hidden under the workpiece cloth. Therefore, it is difficult for the user to properly position the separate set of magnets to the position of the magnets provided in the outer frame.

An object of the present invention is to provide a cloth holding device capable of simply and reliably holding the workpiece cloth by allowing the workpiece cloth held in the predetermined position to be readily released so that the workpiece cloth can be placed in the desired position in a step-by-step manner by establishing and releasing the hold of the workpiece cloth.

MEANS TO OVERCOME THE PROBLEM

The cloth holding device of the present invention includes a support frame made of magnetic material and a presser frame, clamping a workpiece cloth therebetween; an attachment unit provided in the presser frame and pressing the presser frame against the support frame by a magnetic attraction exerted between the support frame and the presser frame; a positioning unit that positions the attachment unit to the presser frame; characterized in that the attachment unit is detachable from a a presser frame surface opposite a surface pressing the workpiece cloth.

The cloth holding device of the present invention including a support frame made of magnetic material and a presser frame, clamp a workpiece cloth therebetween; including an attachment unit provided in the presser frame and movable between an attached position proximate the support frame and a detached position spaced from the support frame; a switch unit that switches the attachment unit between the attached position and the detached position; characterized in that the attachment unit, when in the attached position, presses the presser frame against the support frame by a magnetic attraction exerted between the presser frame and the support frame.

The cloth holding device of the present invention including a plate-form or a frame-form support member made of magnetic material and a presser frame, clamping a workpiece cloth therebetween; an attachment unit provided in the presser frame and pressing the presser frame against the support member by a magnetic attraction exerted between the support member and the presser frame; a positioning unit that positions the attachment unit to the presser frame; characterized in that the attachment unit is detachable from a presser frame surface opposite a surface pressing the workpiece cloth.

The cloth holding device of the present invention including a plate-form or a frame-form support member made of magnetic material and a presser frame, clamping a workpiece cloth therebetween; an attachment unit provided on the support member and movable between an attached position proximate the presser frame and a detached position spaced from the support frame; a switch unit that switches a position of the attachment unit between the attached position and the detached position; characterized in that attachment unit when in the attached position, presses the support member against the presser frame by a magnetic attraction exerted between the support member and the presser frame.

EFFECT OF THE INVENTION

According to the cloth holding device of the present invention, since the presser frame is pressed against the support frame by attaching an attachment unit to the presser frame after clamping the workpiece cloth between the support frame and the presser frame, the workpiece cloth can be held firmly between the support frame and the presser frame. Also, since the attachment unit is positioned by the positioning unit, the attachment of the attachment unit to the presser frame is simplified. Also, even after the workpiece cloth is held by the support frame, presser frame, and attachment unit, the workpiece cloth can be stretched and be positioned readily and reliably to the desired position by removing and thereafter reattaching a part of the attachment unit in a step-by-step manner.

Also, in the case where the attachment unit is arranged to be switchable from the detached position to the attached position by the switch unit, the attachment unit is consistently mounted to the presser frame, thereby preventing the attachment unit from being lost.

EXPLANATION OF REFERENCE SYMBOLS

Reference symbol W designates a workpiece cloth; 10, 20, 30, 40, 50, a cloth holding device; 11, 31 and 51 a support frame; 12, 22, 32, and 52, a presser frame; 13, 23, 33, 43, and 53 a magnet; 15 and 25, magnet location unit; 21 and 41, a support member; and 35, 45, and 55, a magnet position switch unit.

THE BEST MODE FOR CARRYING OUT THE INVENTION

First Embodiment

FIGS. 1 to 7 indicate the first embodiment of the present invention.

Figure 1:
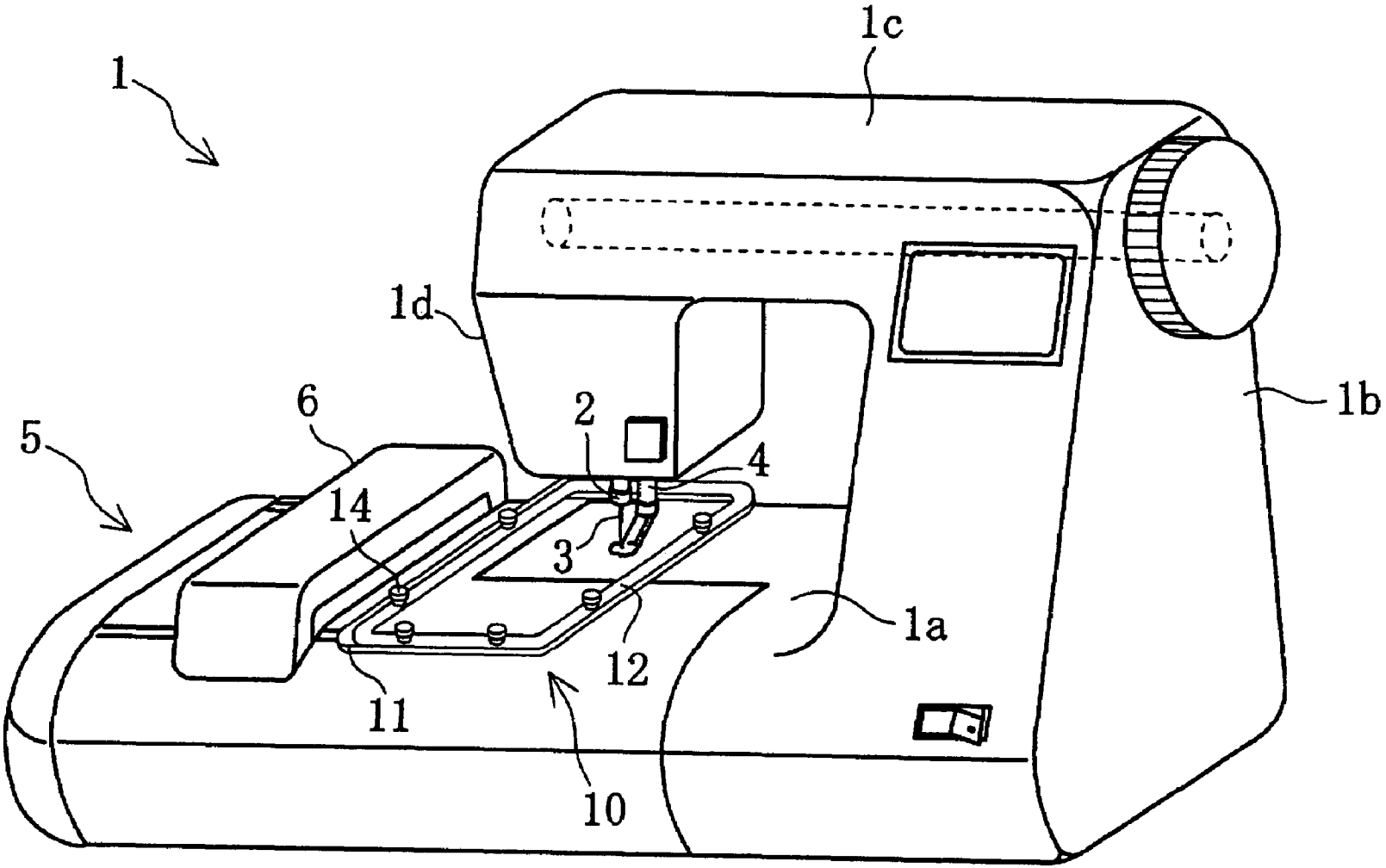
FIG. 1 is a plan view of an embroidery sewing machine in accordance with a first illustrative aspect of the present invention.
Figure 2:
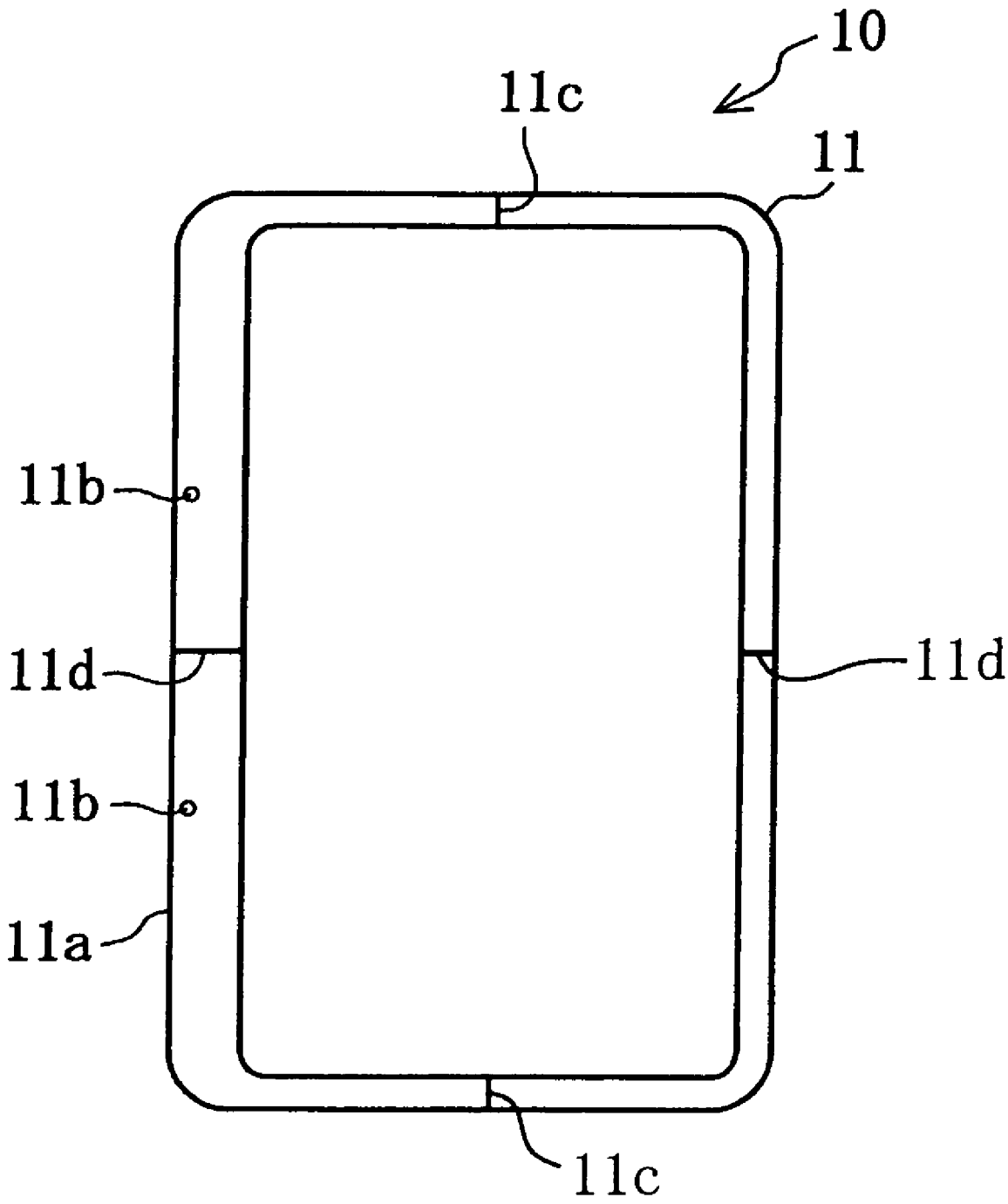
FIG. 2 is a plan view of support frame of the cloth holding device.
Figure 3:
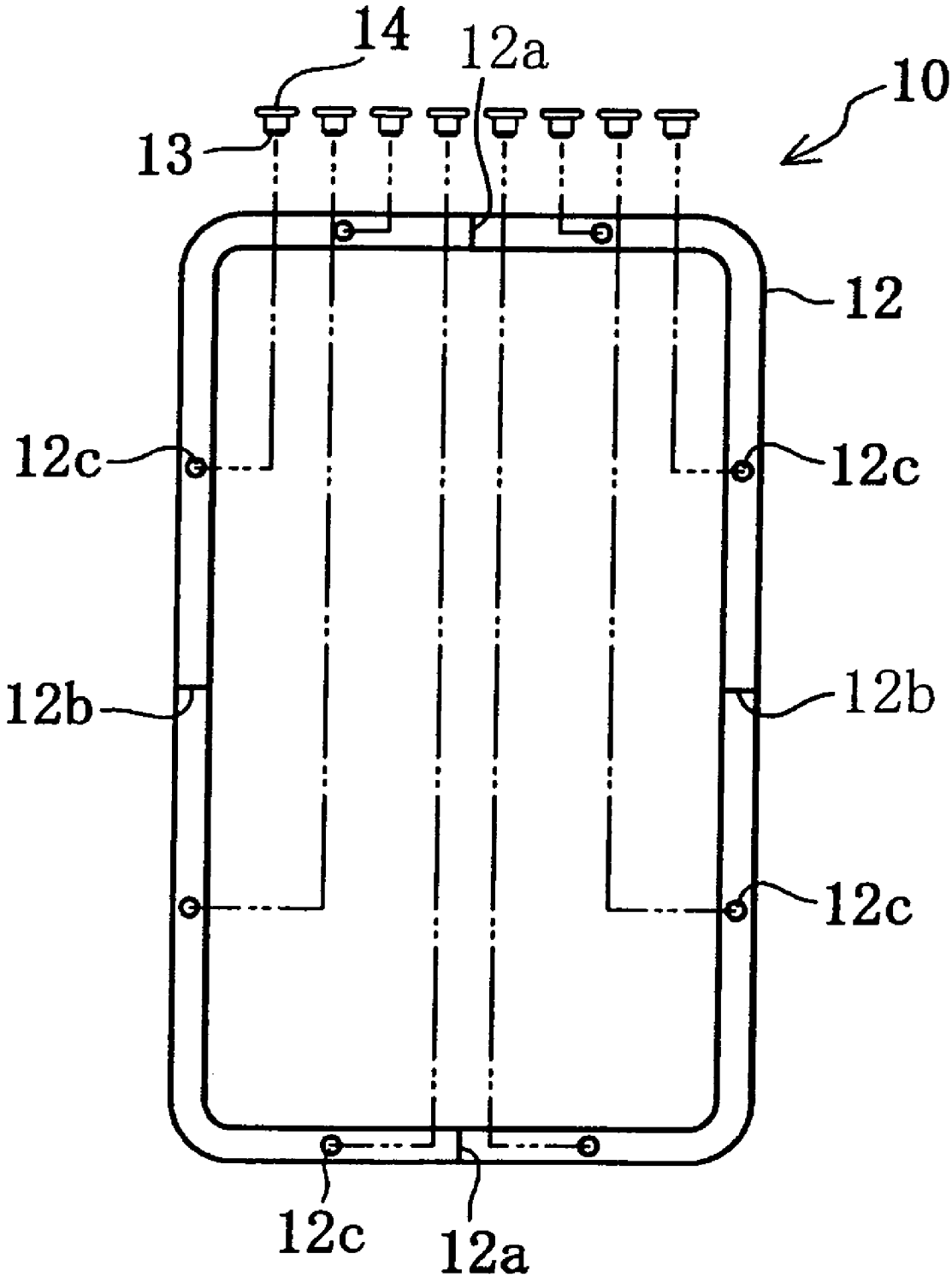
FIG. 3 is a plan view of a presser frame and a plurality of magnets.
Figure 4:
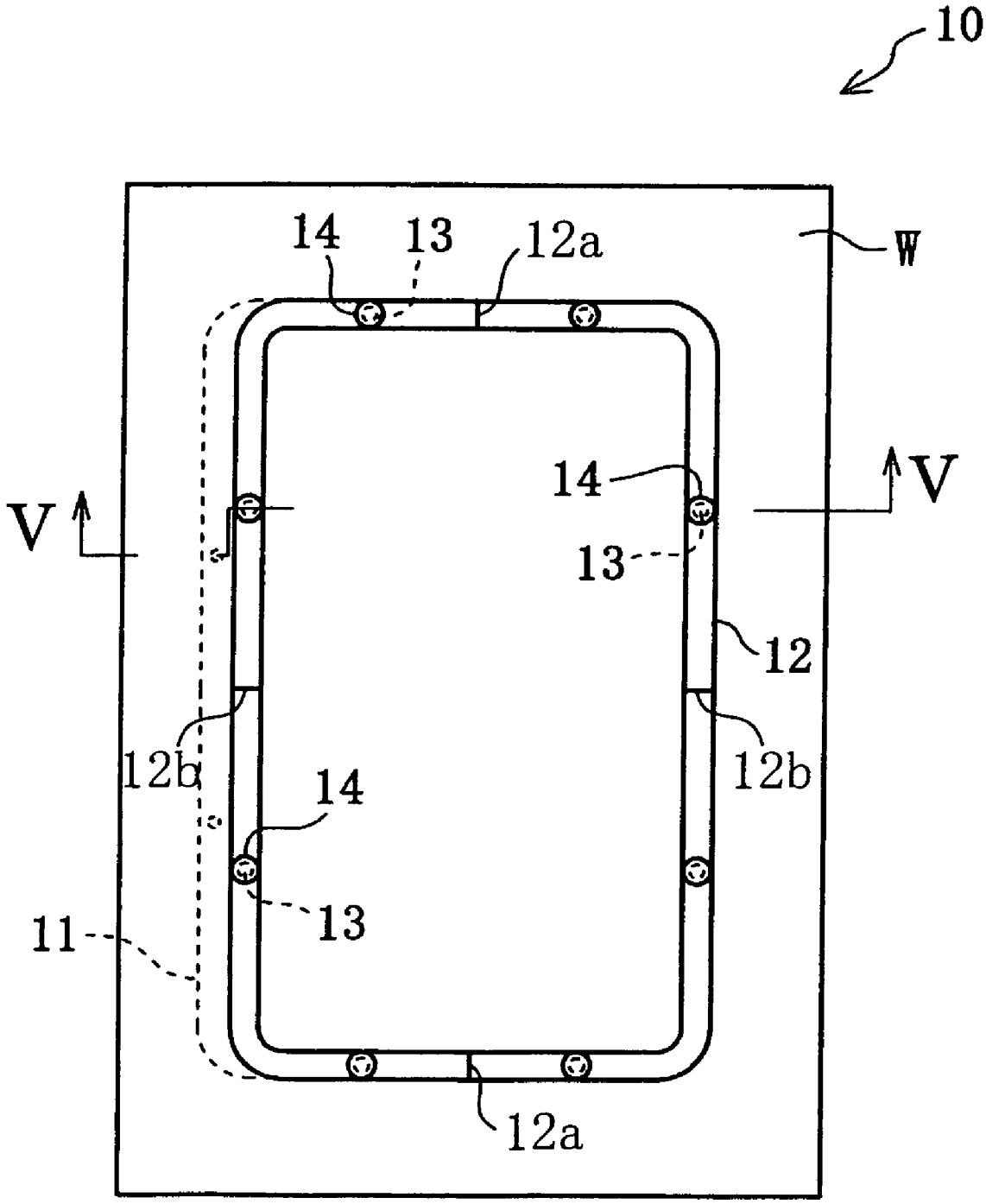
FIG. 4 is a plan view of a cloth holding device (cloth holding state)
Figure 5:
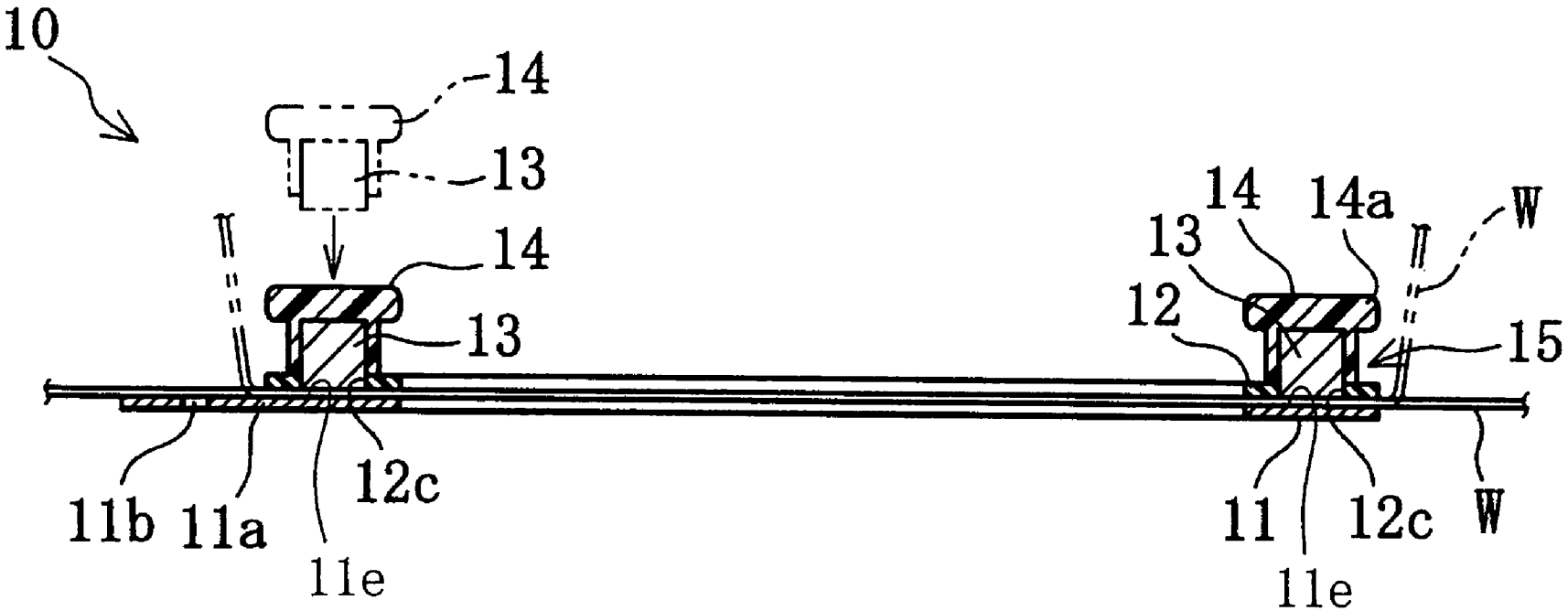
FIG. 5 is a section view taken along line 5-5 in FIG. 4.

A cloth holding device 10 of the present embodiment is used in an embroidery sewing machine 1 of a type as shown in FIG. 1 for stretching and holding a workpiece cloth W to be sewn.

As shown in FIG. 1, the embroidery sewing machine 1 includes a bed 1*a*, a foot 1*b*, an arm 1*c*, and a head 1*d*. Also, a needle bar 2 with a sewing needle 3 attached to the lower end thereof is supported vertically movably to the head 1*d*. Also, a cloth presser 4 is supported by the head 1*d*. An embroidery machine 5 is provided in the bed 1*a*.

The embroidery machine 5 includes a movable body 6 disposed on the upper surface side of the bed 1*a* and supported laterally movably; a mechanism that laterally drives the movable body 6; a carriage 7 (refer to FIG. 6) supported longitudinally movably by the movable body 6; a mechanism that drives the carriage 7 in the longitudinal direction; and a connection mechanism 8 (refer to FIG. 6) disconnectably connecting the cloth holding device 10 to the carriage 7. The cloth holding device 10 is driven in the longitudinal and lateral directions by the embroidery machine 5.

Figure 6:
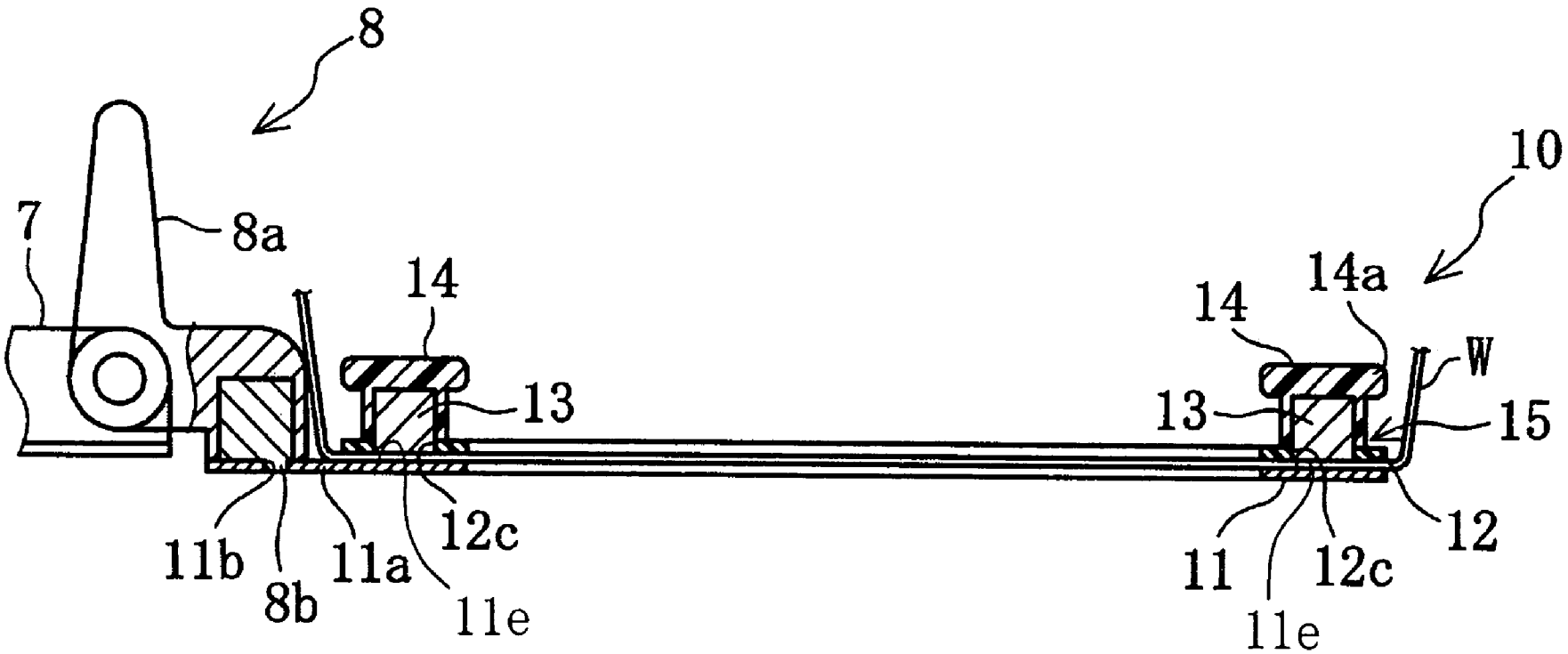
FIG. 6 is a vertical section view of the cloth holding device in a connected state so as to be capable of sewing.
Figure 7:
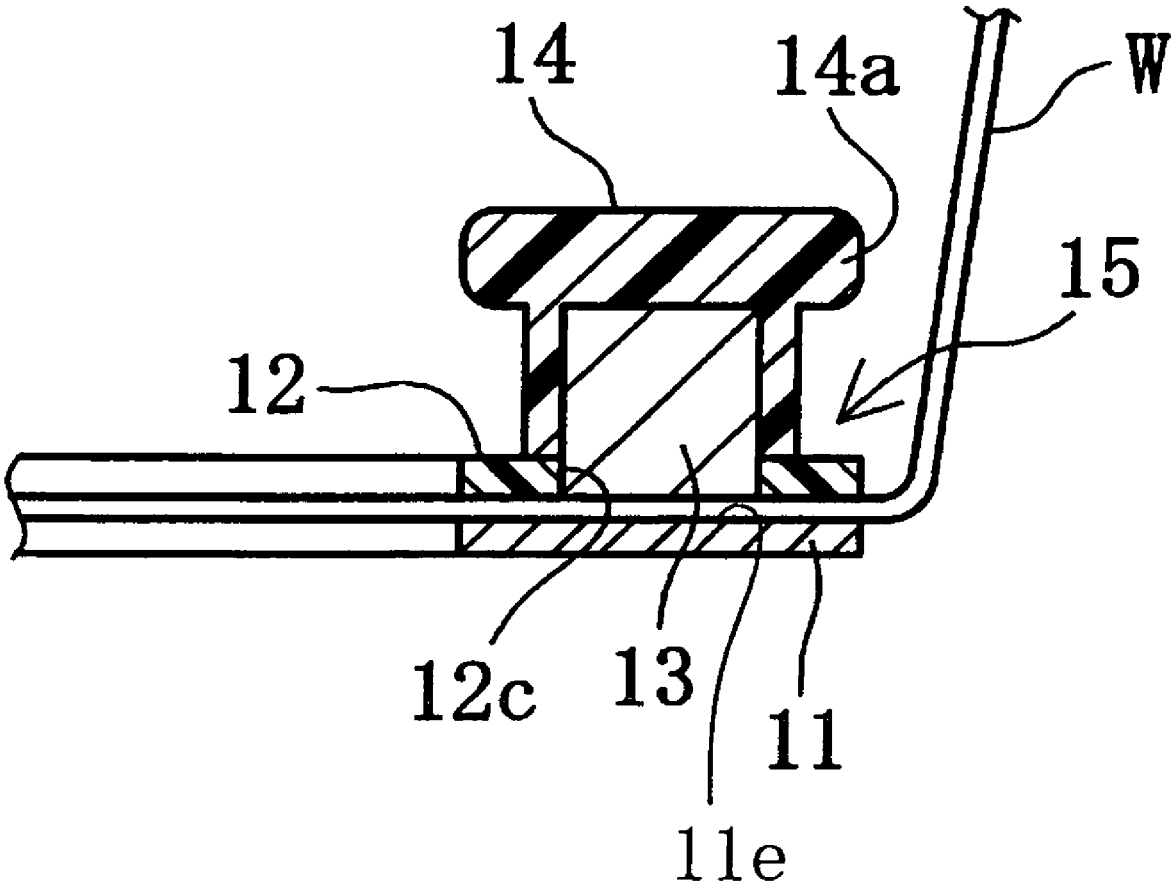
FIG. 7 is a vertical section view of a main portion of the cloth holding device.
Figure 8:
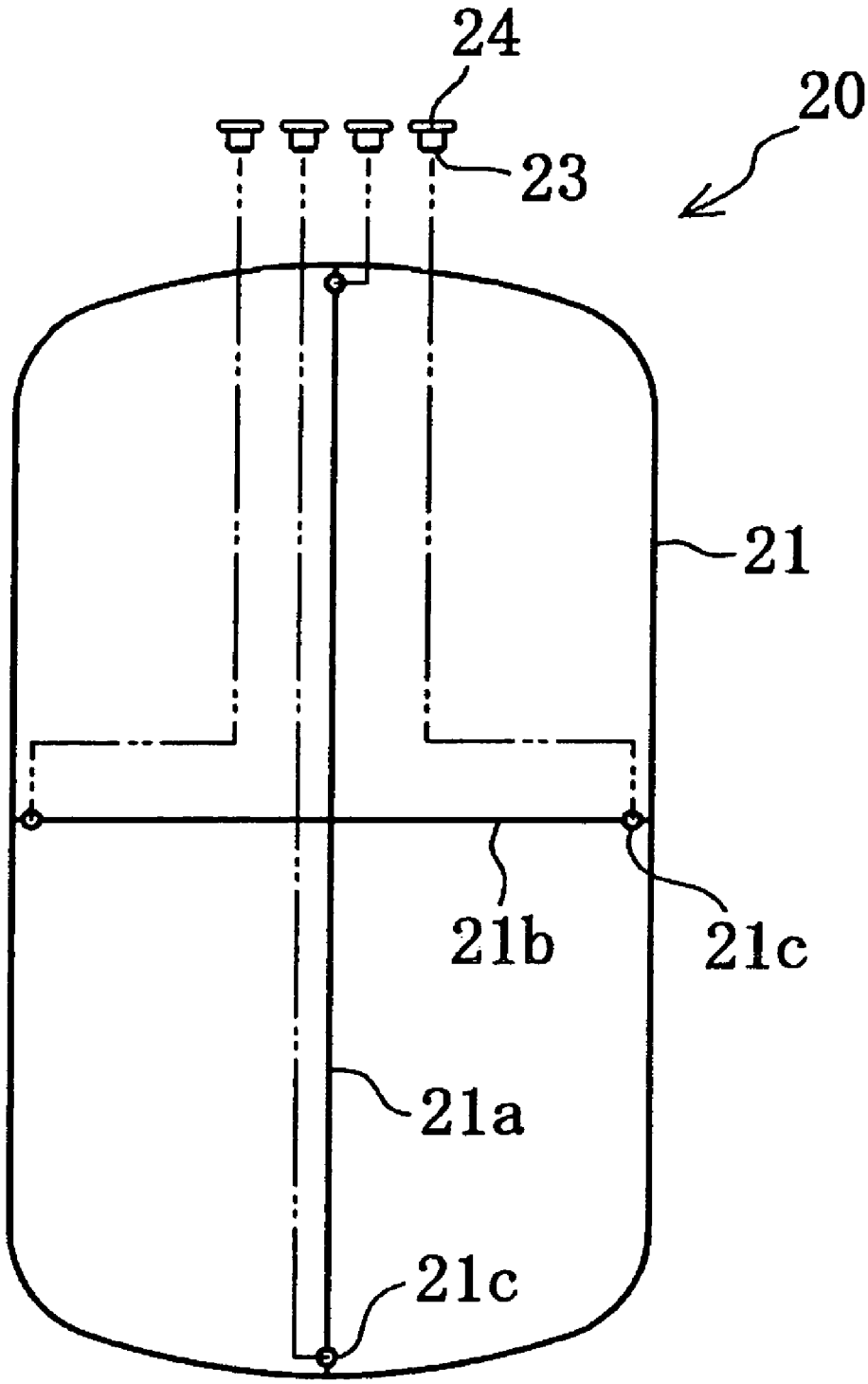
FIG. 8 is a plan view of a support member and a plurality of magnets of the cloth holding device according to a second illustrative aspect.
Figure 9:
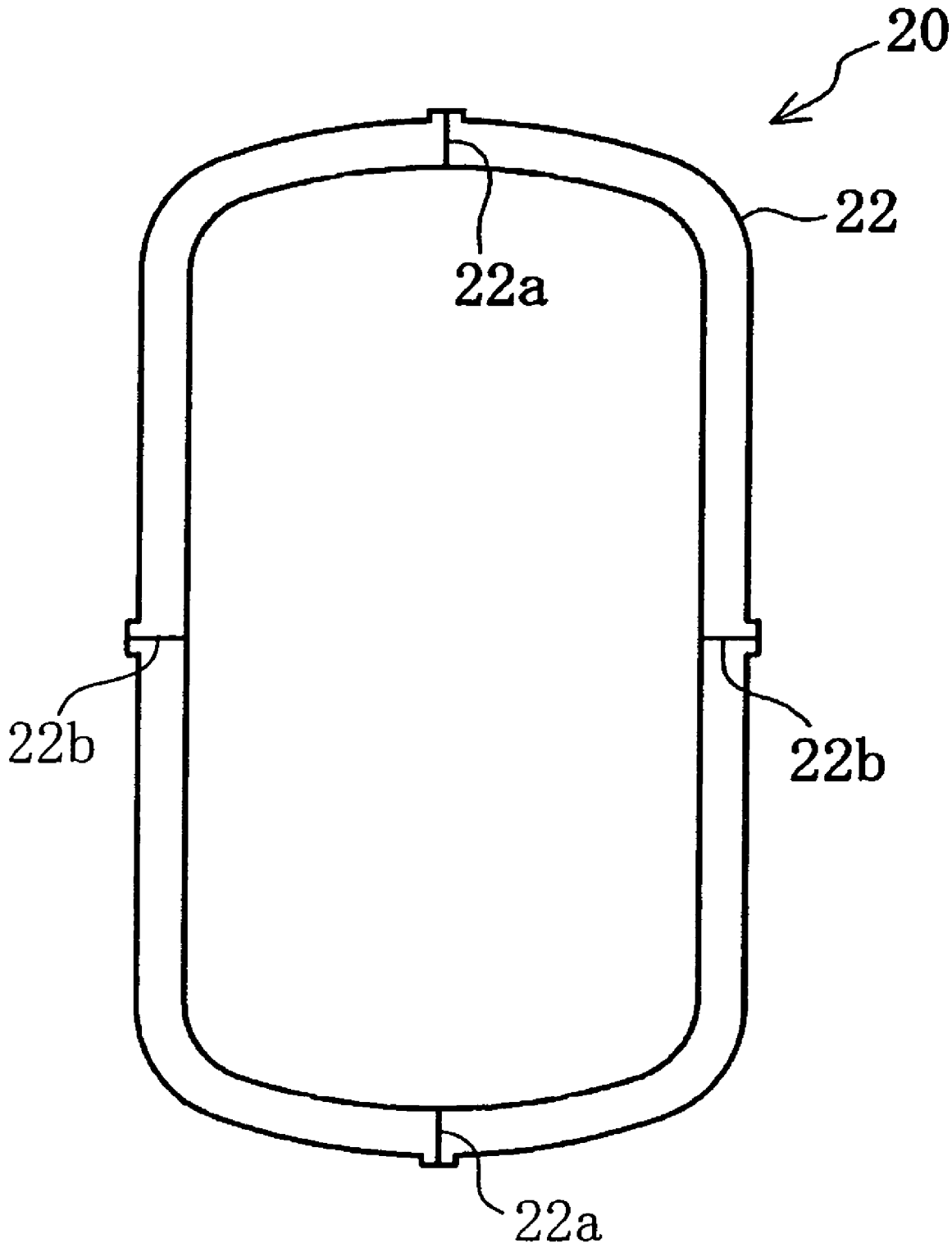
FIG. 9 is a plan view of the presser frame.
Figure 10:
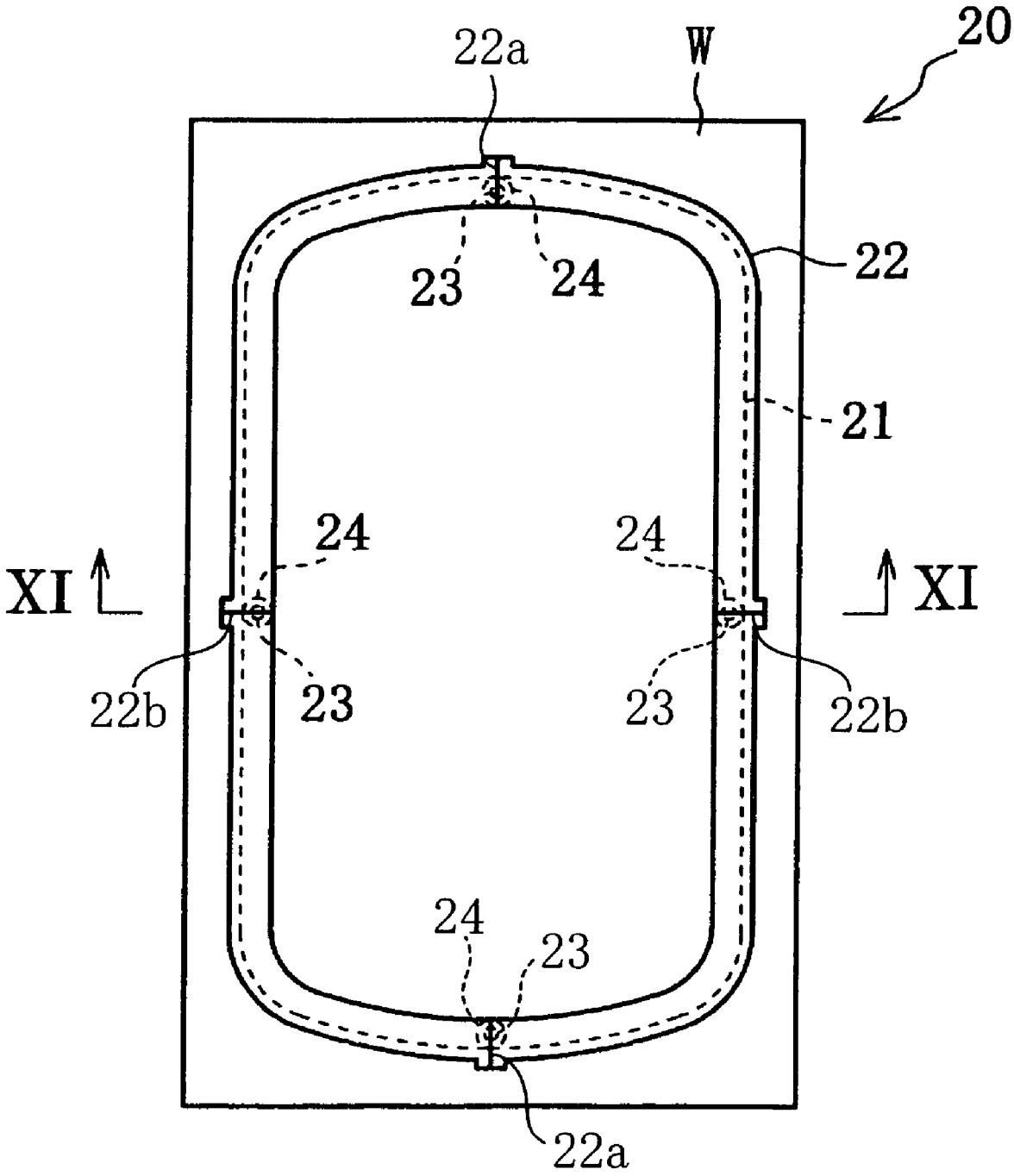
FIG. 10 is a plan view of the cloth holding device (in cloth holding state)
Figure 11:
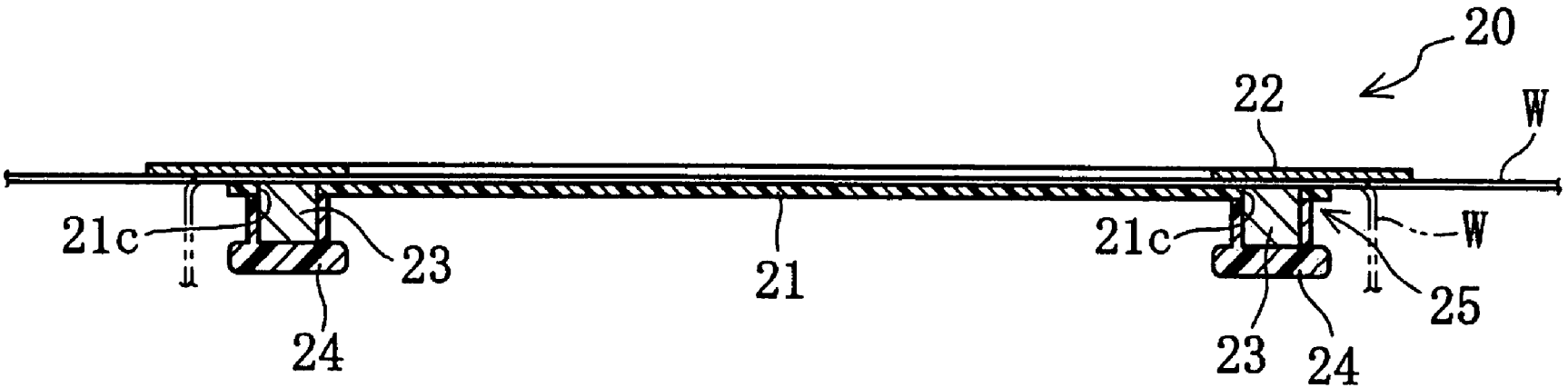
FIG. 11 is a section a1 view taken along line 11-11 in FIG. 10.

The cloth holding device 10 will be described with reference to FIGS. 2 to 7. The cloth holding device 10 includes a support frame 11 made of a magnetic material having a thickness of approximately 1 mm and a presser frame 12 made of synthetic resin also having a thickness of approximately 1 mm. The support frame 11 and the presser frame 12 are formed substantially in the same shape and size. The workpiece cloth W is clamped between the support frame 11 and the presser frame 12. The support frame 11 has center line indicators 11*c* and 11*d*, indicating the two intersecting center lines of the support frame 11, formed thereto; and the presser frame 12 also has center line indicators 12*a* and 12*b*, indicating the two intersecting center lines, formed thereto. The support frame 11 has a connection piece 11*a* that projects further toward the connection mechanism 8 relative to the presser frame 12 when the presser frame 12 is centered to the support frame 11, and a pair of connection holes 11 is defined on the connection piece 11*a*. As shown in FIG. 6, the connection mechanism 8 has a lever 8*a* pivoted to the carriage 7, and a pair of engagement projections 8*b* are provided on the distal end of the lever 8*a*. The pair of engagement projections 8*b* is engaged with the pair of engagement holes 11*b*, connecting the carriage 7 and the support frame 11.

Also, a plurality (eight, for example) of magnets 13 are attached to the presser frame 12 by being held respectively by a plurality (eight, for example) of magnet holding members 14 made of synthetic resin. The magnet 13 and the magnet holding member 14 constitute the attachment unit. The magnet 13 is formed as a short cylinder, having a diameter approximately ½ of the width of each support piece of the support frame 11. The magnet holding member 14 has the magnet 13 fitted therein and the distal end of the magnet 13 projects approximately 1 mm from the magnet holding member 14. A flanged tip 14*a* is provided on the base end of the magnet holding member 14 to allow the user to hold the same with the finger tips. The plurality of magnets 13 and the plurality of magnet holding members 14 are attached to the support frame 11 from the presser frame 12 side (upper side). At this time, the plurality of magnets 13 are respectively positioned removably to the presser frame 12 from the opposing side of the support frame 11 (upper side) by the magnet positioning unit (positioning unit).

The magnet positioning unit 15 will be described hereinafter. A plurality (eight, for example) of engagement holes 12*c* are defined in the presser frame 12. The diameter of the engagement hole 12*c* is arranged so as to be equal to or slightly larger than the diameter of the magnet 13. Such engagement holes 12*c* are defined in an appropriate position so as to allow the workpiece cloth W to be pressed evenly against the support frame 11 by the magnetic attraction of the plurality of magnets 13 engaged with the engagement holes 12*c*. Thus, the magnet positioning unit 15 is constituted by the engagement holes 12*c* and the magnets 13. The distal end of the magnet 13 is positioned to each engagement hole 12*c*, consequently positioning the magnet 13 to the presser frame 12. The contact or the approach of the magnet 13 in close proximity with the support surface 11*e* of the support frame 11 brings the lower end surface of the magnet holding member 14, in the opposite side of the tip 14*a* thereof, in contact with the presser frame 12, thereby pressing the workpiece cloth W against the support frame 11.

According to the cloth holding device 10, when holding the workpiece cloth W, the workpiece cloth W is placed on the support frame 11 and the presser frame 12 is placed on the support frame 11 so as to clamp the workpiece cloth W therebetween. In this state, when the magnet 13 is engaged with the engagement hole 12*c* defined on the presser frame 12, the magnet 13 is thereby positioned and attached to the presser frame 12 with the lower end surface of the magnet holding member 14 contacting the presser frame 12. Thus, the workpiece cloth W is pressed against the support frame 11 by the magnet 13 and the presser frame 12 as well, thereby establishing the hold of the workpiece cloth W.

When the plurality of magnets 13 are attached to the presser frame 12 so as to be attached to the support frame 11, the hold of the workpiece cloth W is established in a step-by-step manner by the support frame 11, the presser frame 12 and the magnet 13 by performing an operation of stretching and positioning the workpiece cloth, and further by removing a part of the magnets 13 attached to the support frame 11 and reattaching the same for repositioning of the workpiece cloth W for further stretching of the workpiece cloth W. Thus, the workpiece cloth W can be stretched and held in the desirable position between the support frame 11 and the presser frame 12 in an easy and reliable manner.

The ease of attaching/detaching the plurality of magnets 13 to/from the presser frame 12 is improved since the magnet holding member 14 provides better hold of the magnets 13.

Since the magnet positioning unit 15 has a plurality of engagement holes 12*c* defined in the presser frame 12 that receive the plurality of magnets 13 respectively by the engagement of each magnet 13 with the engagement hole 12*c*, the magnets 13 can be easily and reliably positioned to the presser frame 12; moreover such arrangement allows the construction of the magnet positioning unit 15 to be simplified, providing advantageous manufacturing cost.

Nothing projects to the underside of the support frame 11 when the workpiece cloth W is held. This enables the support frame 11 to be placed movably in the horizontal direction on the bed la of the embroidery sewing machine 1 and allows connection to the carriage 7 of the embroidery unit 5 by the connection mechanism 8. In other words, the cloth holding device 10 can be applied to the embroidery sewing machine 1 as a device that holds the workpiece cloth W to be sewn. Thus, the improvement of sewing and sewing position accuracy and reduction of sewing work duration can be achieved among other improvements.

Second Embodiment

FIGS. 8 to 12 indicate the second embodiment of the present invention.

The cloth holding device 20 of the present embodiment is attached to an ink-jet printer that prints the workpiece cloth. The printer is used for printing a workpiece cloth W and a part of or the entire embroidery pattern sewn by the embroidery sewing machine 1.

The cloth holding device 20 includes a support member 21 in a flat plate-form made of synthetic resin having a thickness of approximately 1 mm and a presser frame 22 made of magnetic material having a thickness of approximately 1 mm. The workpiece cloth W is clamped between the support member 21 and the presser frame 22. The support member 21 has center line indicators 21*a* and 21*b*, indicating the two intersecting center lines, formed thereto and the presser frame 22 also has center line indicators 21*a* and 21*b*, indicating the two intersecting center lines, formed thereto. When the presser frame 22 is centered and placed on the support member 21, the presser frame 22 slightly projects outward relative to the support member 21. Also, a plurality of magnets 23 (four, for example) are attached to the support member 21 by being held by a plurality (four, for example) of magnet holding members 24. The manner of connection between the magnet 23 and the magnet holding member 24 is the same as in the first embodiment. The plurality of magnets 23 and the plurality of magnet holding members 24 are attached to the presser frame 22 from the support member 21 side (underside). At this time, the plurality of magnets 23 is removably positioned respectively to the support member 21 by the magnet positioning unit 25 from the opposite side (underside) of the presser frame 22.

The magnet positioning unit 25 (corresponds to positioning unit) is constituted by a plurality of (four, for example) engagement holes 21*c* with which the plurality of magnets 23 are respectively engaged and which is formed near the peripheral edges of the support member 21, and the plurality of magnets 23.

According to such cloth holding device 20, in holding the workpiece cloth W, the workpiece cloth W is placed on the support member 21 and the presser frame 22 is placed on the support member 21 so as to clamp the workpiece cloth W therebetween. When the magnets 23 are engaged with the engagement holes 21*c* defined in the support member 21 in such state, the magnets 23 become positioned and attached to the presser frame 22 with an upper end surface of the magnet holding member 24 contacting the support member 21. Thus, the workpiece cloth W is pressed against the presser frame 22 by the magnet 23, thereby holding the workpiece cloth W.

Magnetic attachment of the plurality of magnets 23 to the presser frame 22 by mounting the magnets 23 to the support member 21 may be carried out after overturning the embroidery frame so that the support member 21 is disposed over the presser frame 22. In the present embodiment also, the hold of the workpiece cloth W is established in a step-by-step manner by the support member 21, presser frame 22, and the magnet 23 by removing a part of the magnets 23 attached to the support frame 21 and reattaching the same for repositioning of the workpiece cloth W for further stretching of the workpiece cloth W. Therefore, the workpiece cloth W can be easily and reliably positioned and held in the desired position between the support member 21 and the presser frame 22 in a stretched manner.

Figure 12:
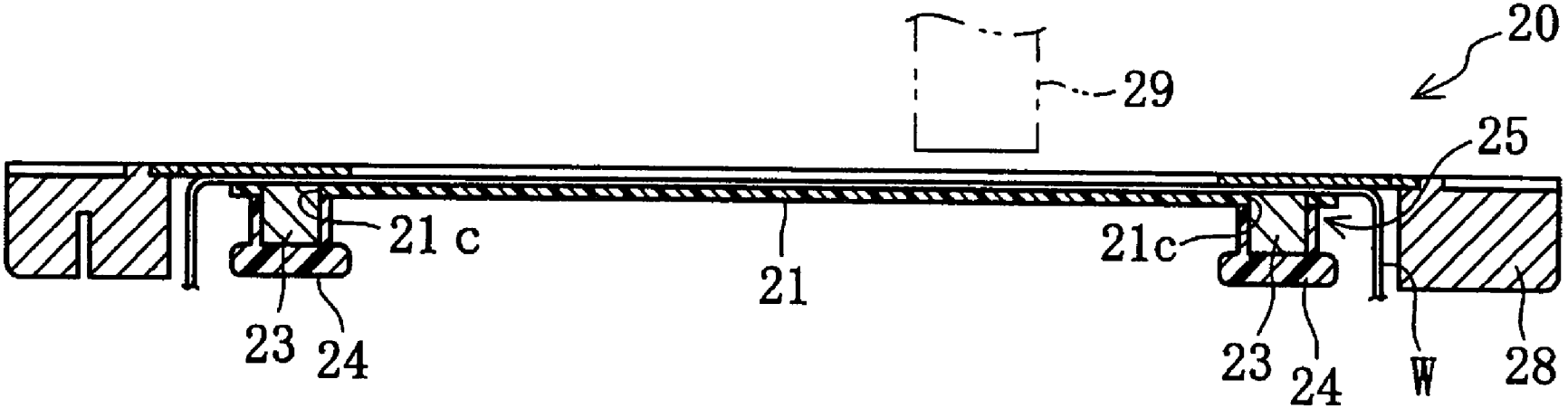
FIG. 12 is a vertical section view of the cloth holding device in a connected state so as to be capable printing.
Figure 13:
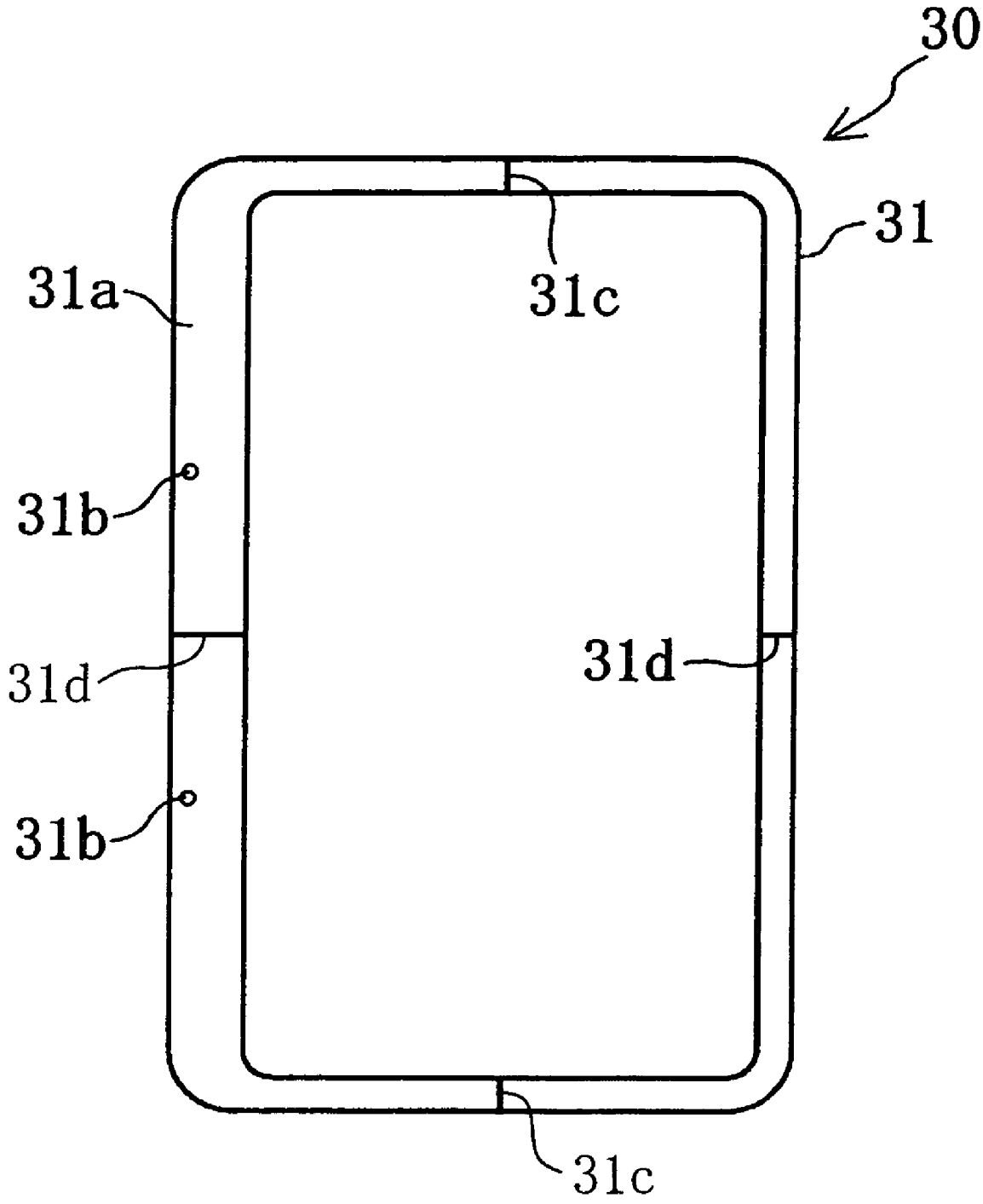
FIG. 13 is a plan view of a support frame of a cloth holding device according to a third illustrative aspect.
Figure 14:
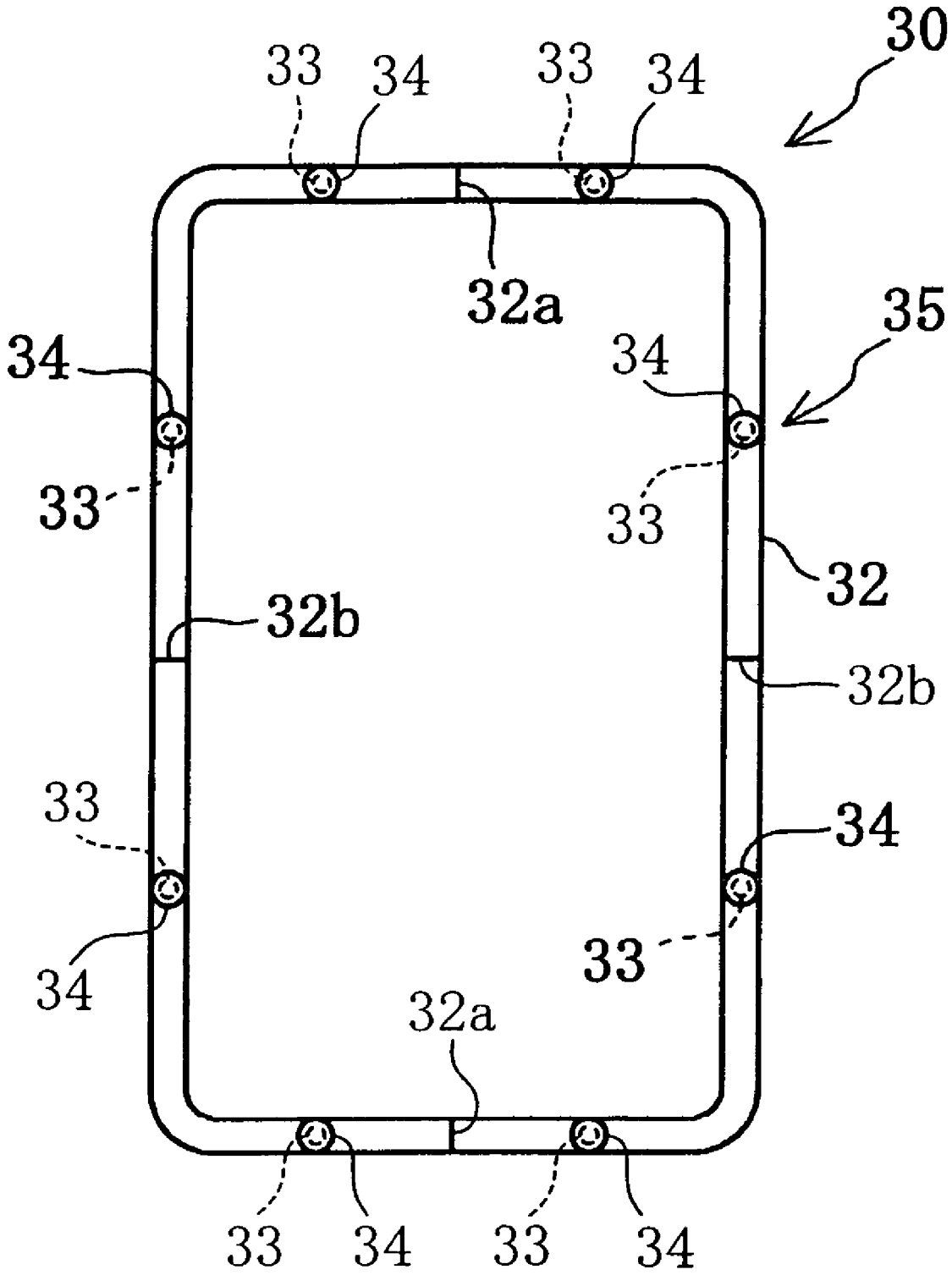
FIG. 14 is a plan view of the presser frame.
Figure 15:
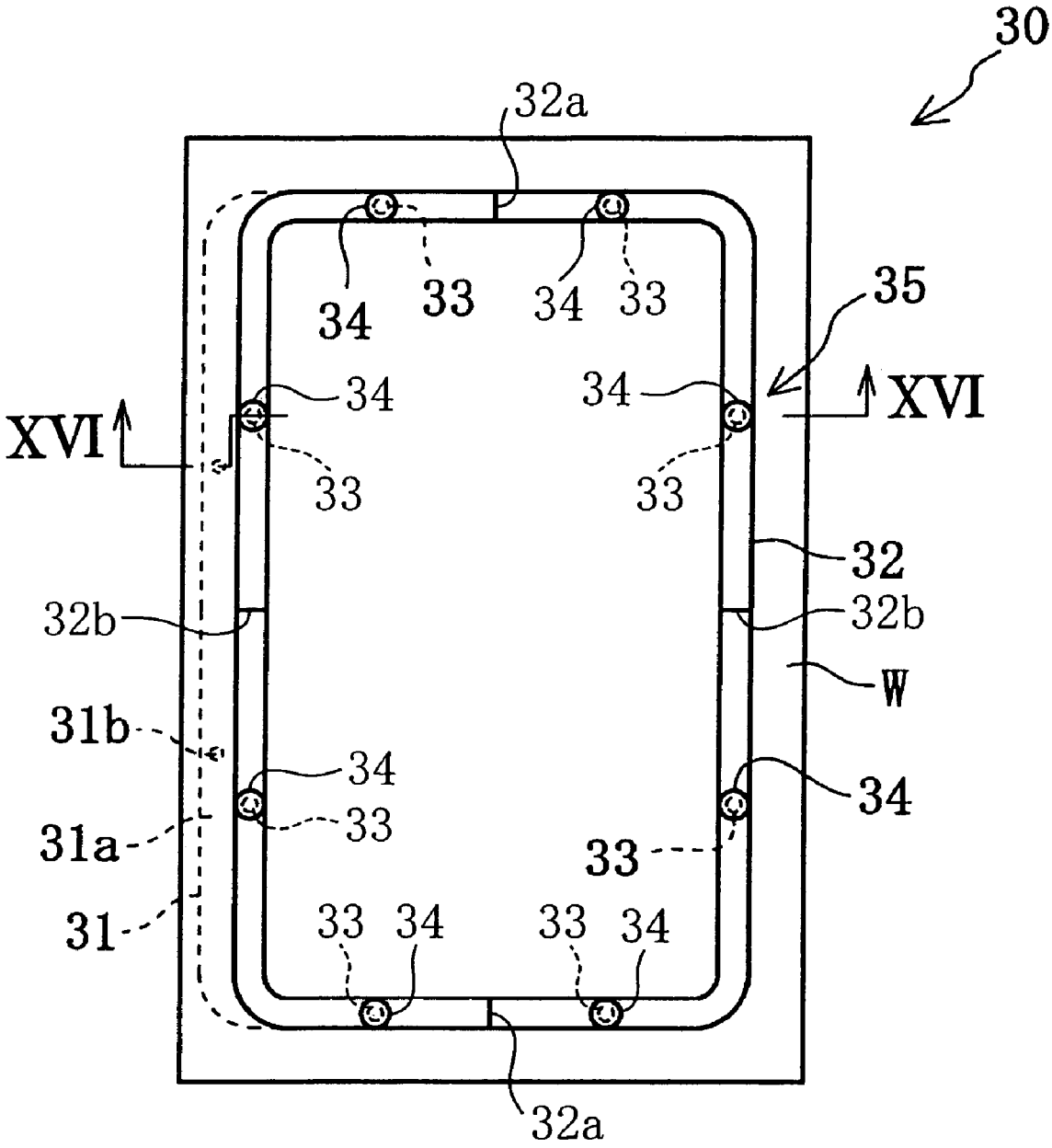
FIG. 15 is a plan view of the cloth holding device (cloth holding state)
Figure 16:
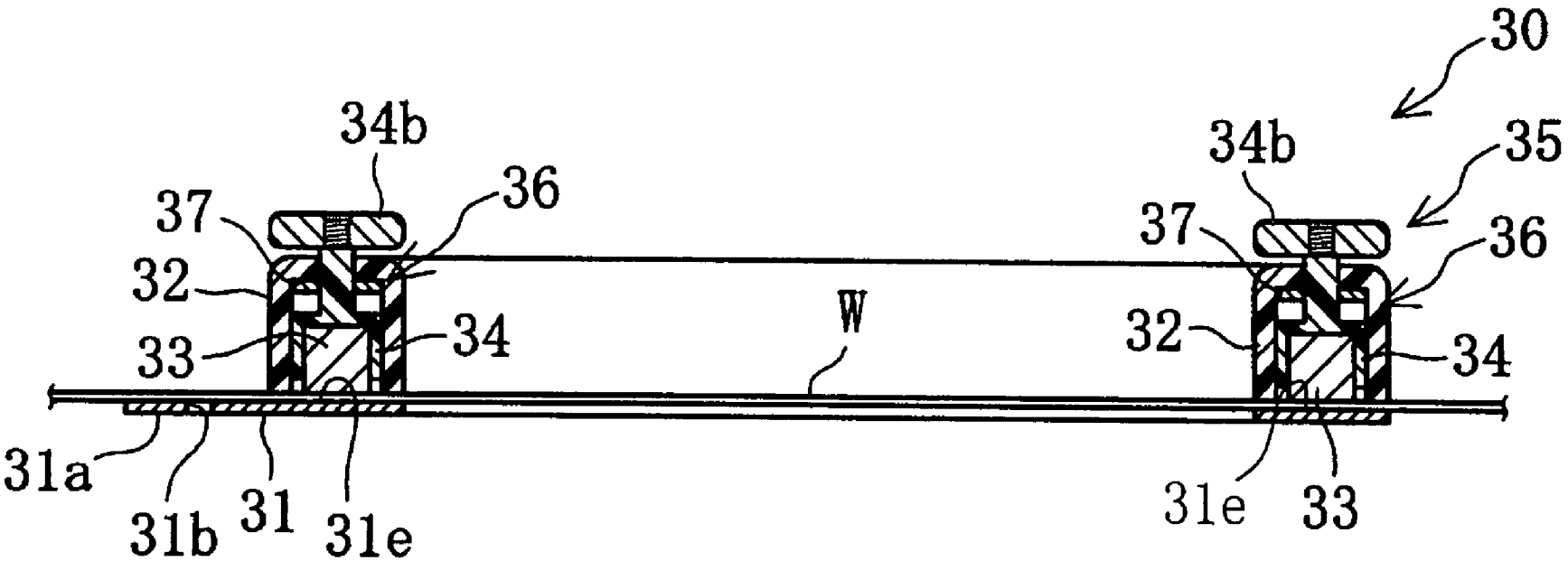
FIG. 16 is a section view taken along line 16-16 in FIG. 15.
Figure 17:
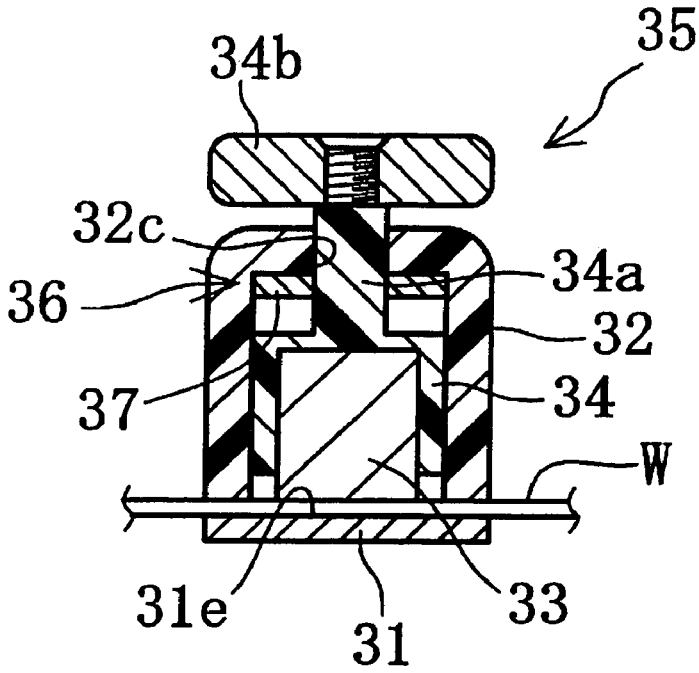
FIG. 17 is a vertical section view of a main portion (magnet attached state) of the cloth holding device.
Figure 18:
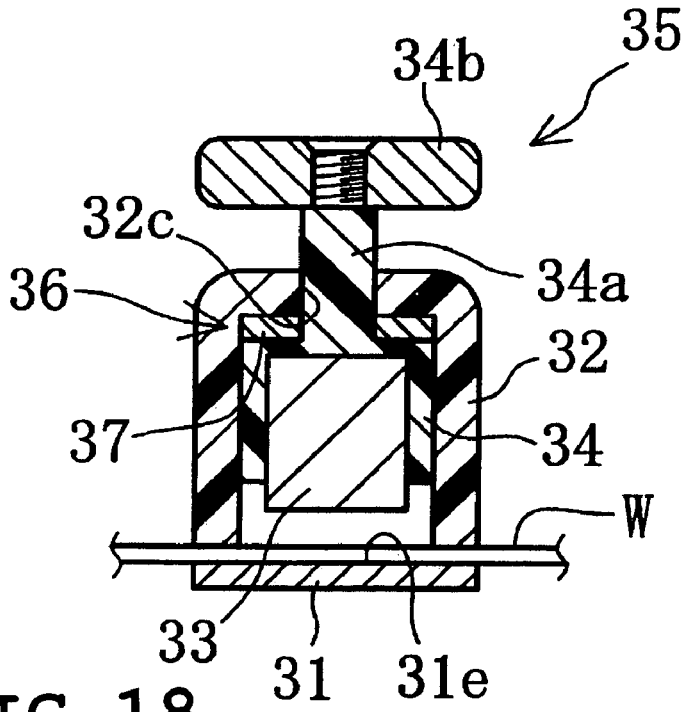
FIG. 18 is a vertical section view of a main portion (magnet detached state) of the cloth holding device.
Figure 19:
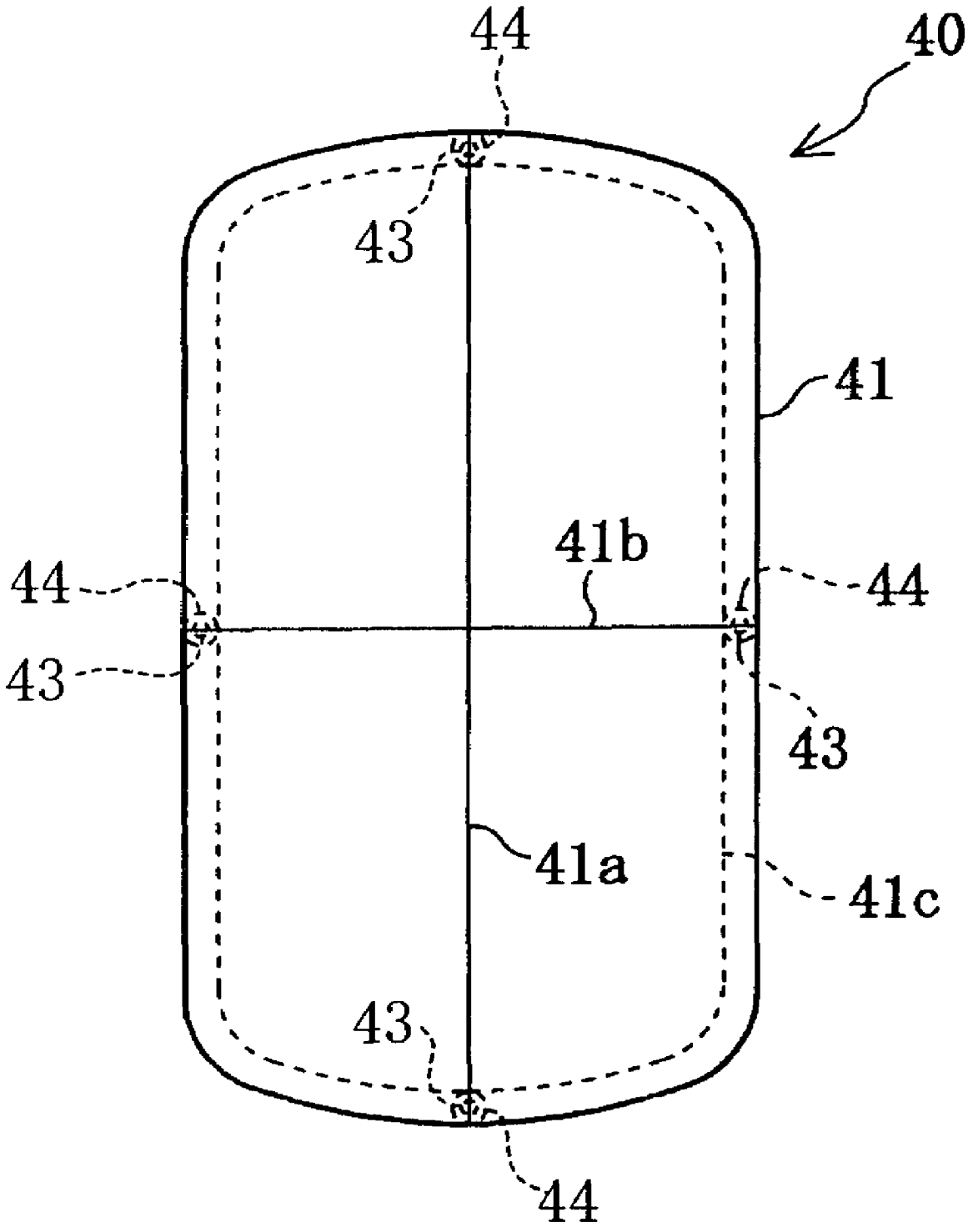
FIG. 19 is a plan view of the support member of the cloth holding device according to a fourth illustrative aspect.
Figure 20:
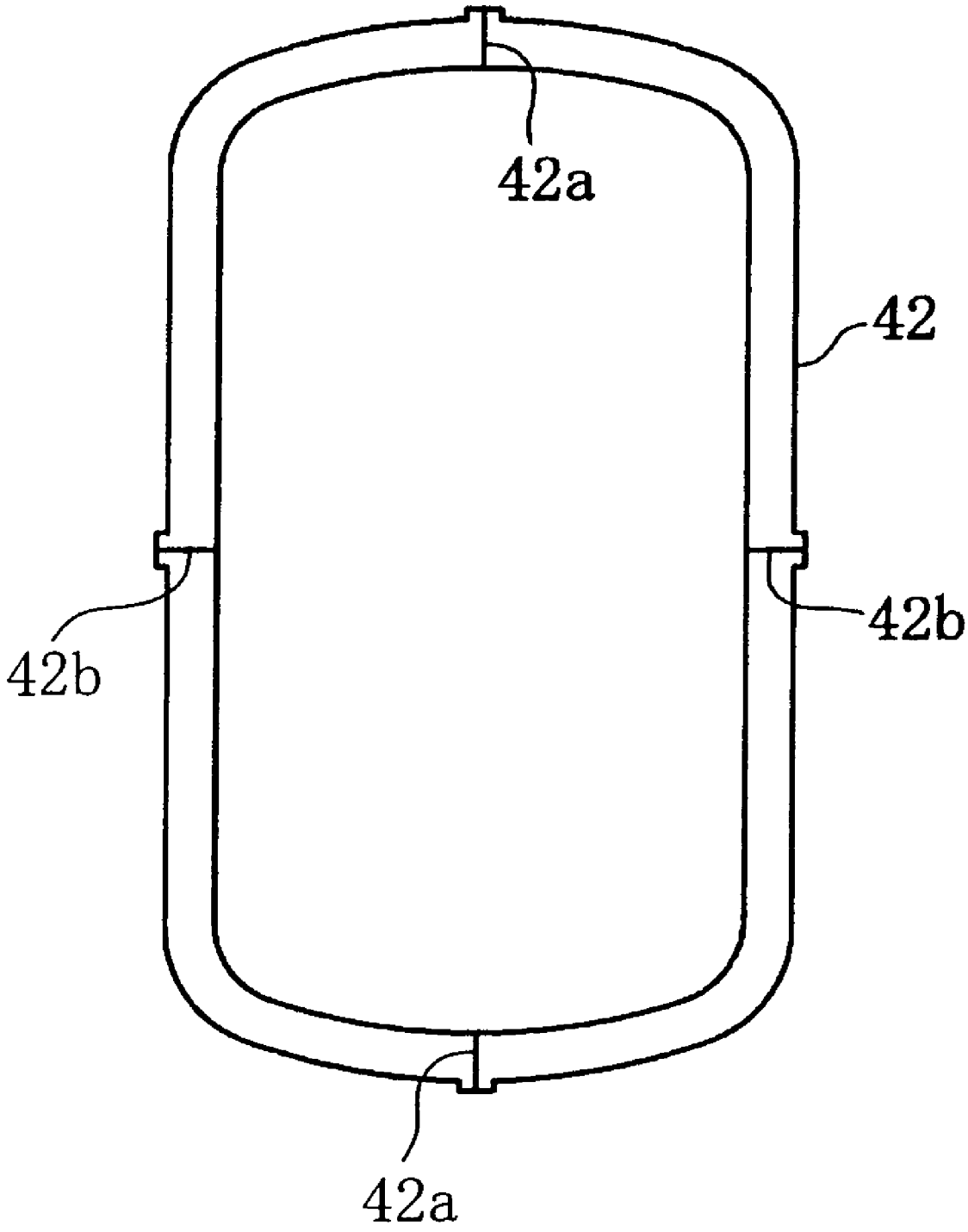
FIG. 20 is a plan view of the presser frame.
Figure 21:
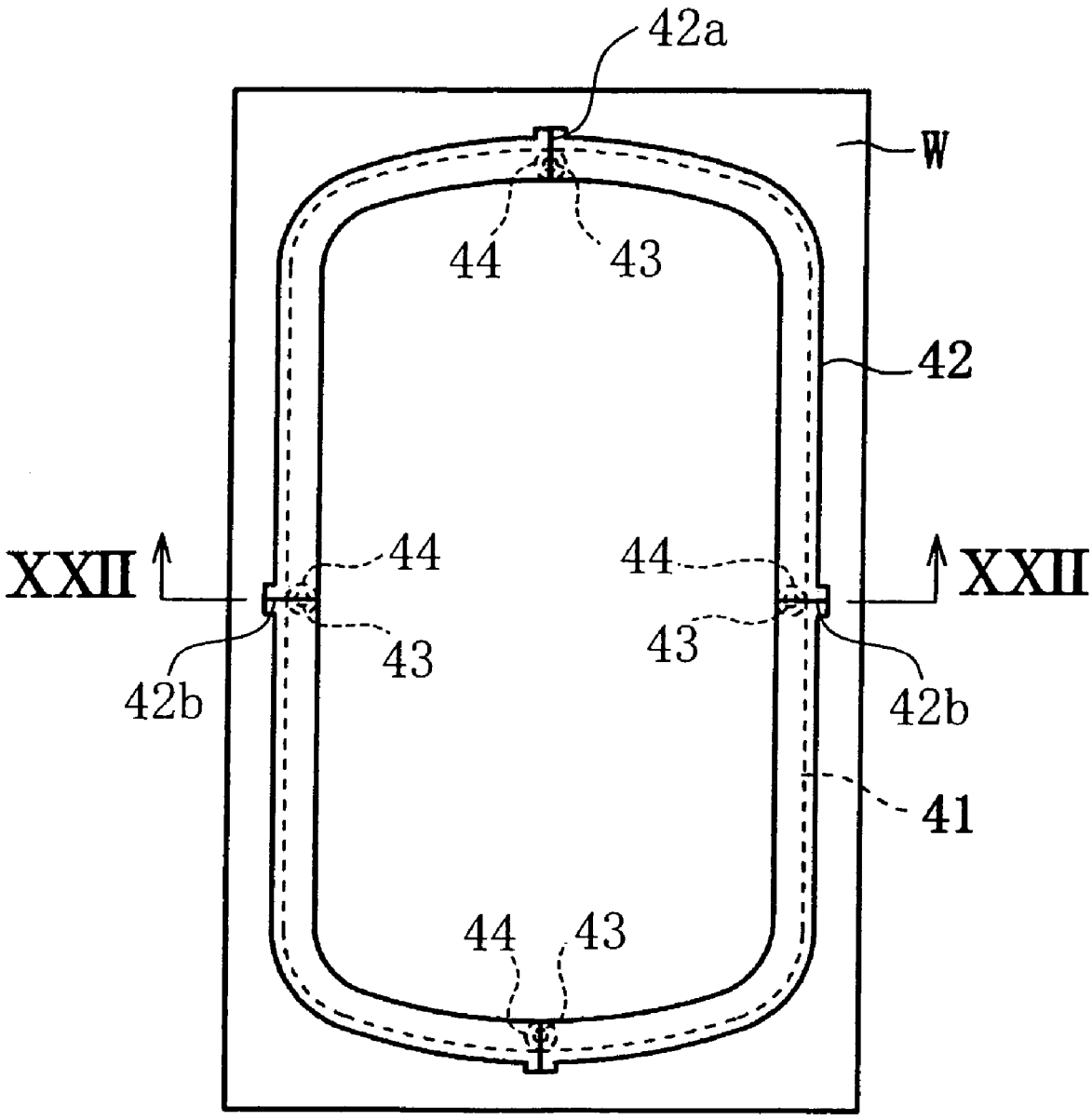
FIG. 21 is a plan view of the cloth holding device (in cloth holding state)
Figure 22:
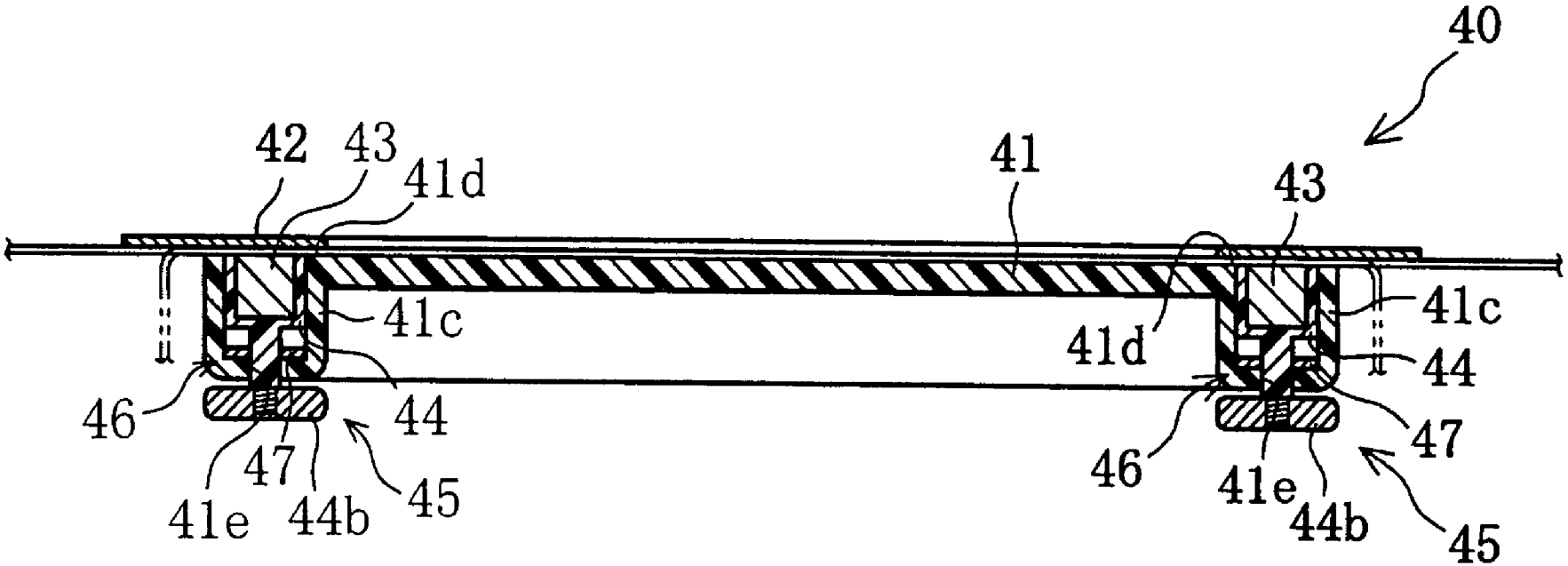
FIG. 22 is a section view taken along line 22-22 in FIG. 21.
Figure 23:
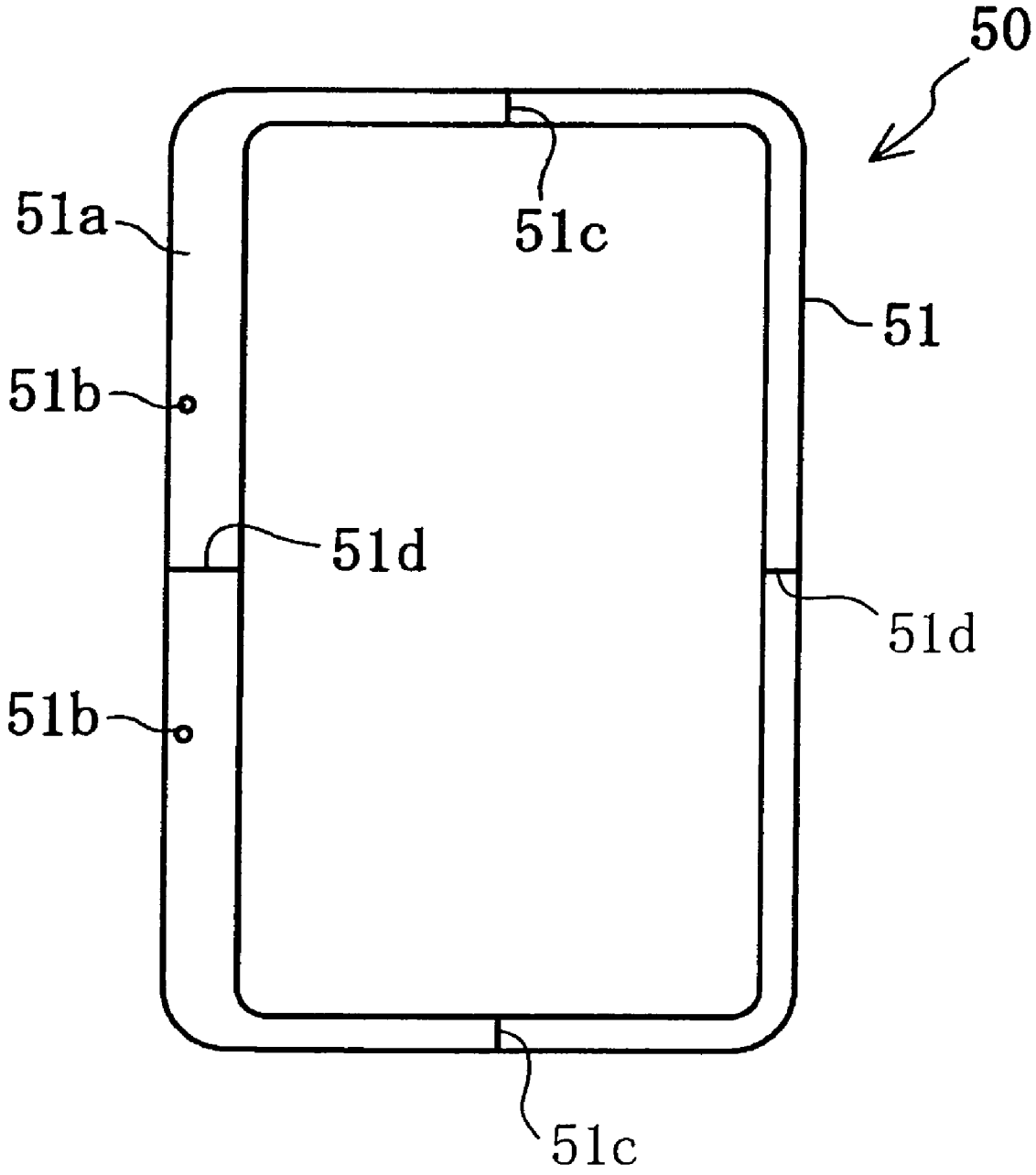
FIG. 23 is a plan view of the support frame of the cloth holding device according to a fifth illustrative aspect.
Figure 24:
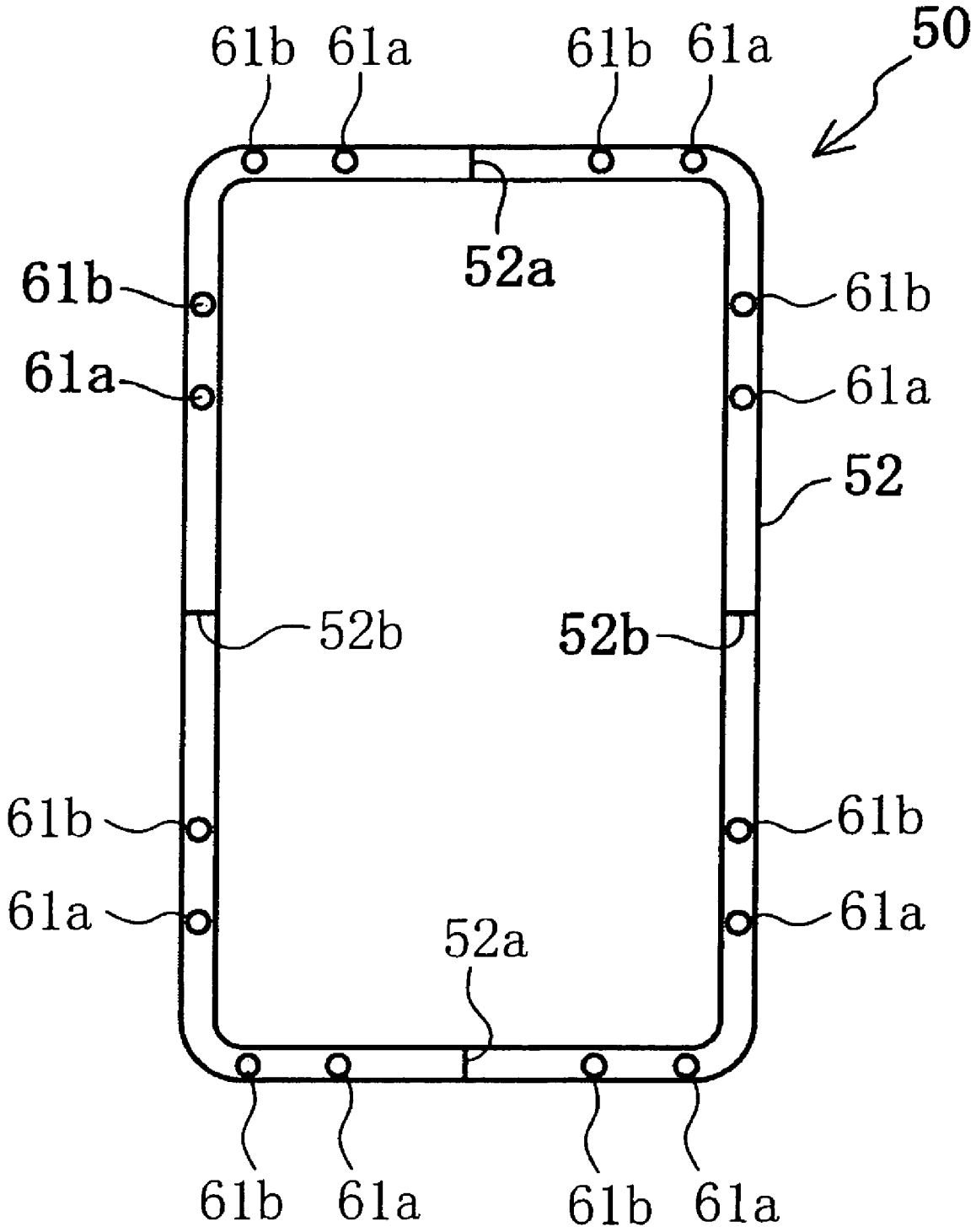
FIG. 24 is a plan view of the presser frame.
Figure 25:
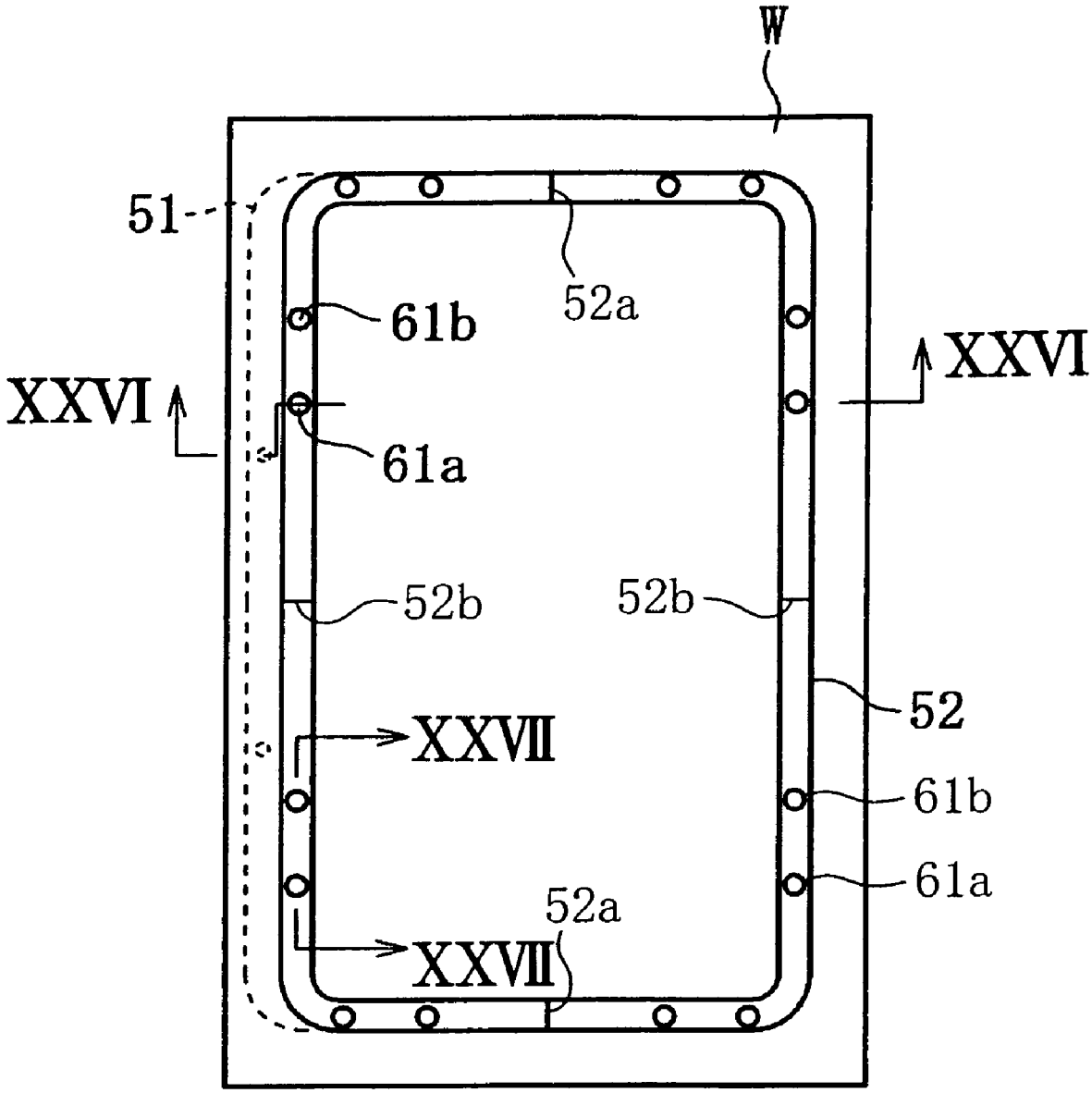
FIG. 25 is a plan view of cloth holding device (cloth holding state)
Figure 26:
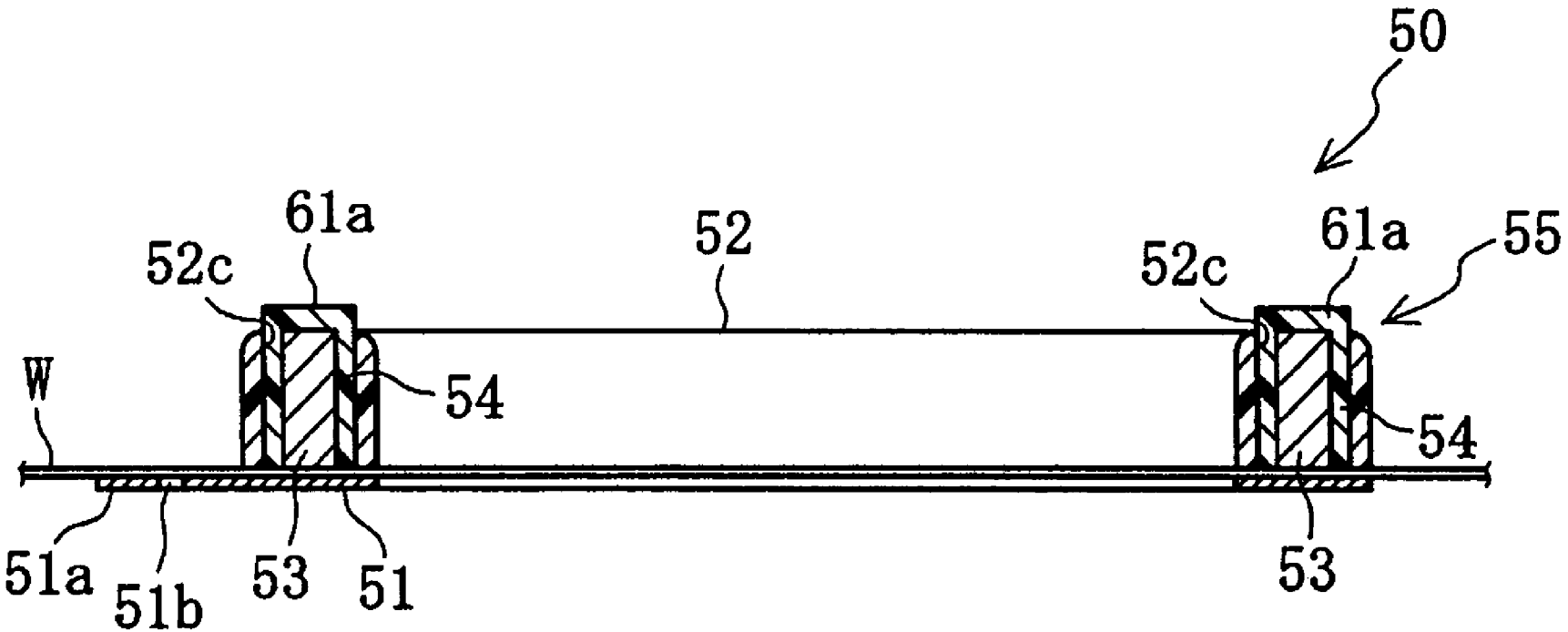
FIG. 26 is a section view taken along line 26-26 in FIG. 25.

As shown in FIG. 12, in printing the workpiece cloth W and the embroidery pattern sewn on the workpiece cloth W, the workpiece cloth W is held by the cloth holding device 20 with the printing surface of the workpiece cloth W directed toward the opposite side (upper side) of the support member 21. Thereafter, the portion of the presser frame 22 of the cloth holding device 20 projecting outward relative to the support member 21 is connected to a predetermined support member 28. Consequently, the workpiece cloth W and the embroidery patterns sewn on the workpiece cloth W can be printed reliably by moving the printer head 29 relative to the workpiece cloth W with the printer head 29 disposed in close proximity of the printing surface of the workpiece cloth W, with no interference imposed by the plurality of magnet pieces 23 in the support member 21 side (underside).

Third Embodiment

FIGS. 13 to 18 indicate the third embodiment.

A cloth holding device 30 of the third embodiment is employed in the embroidery sewing machine 1 of a type as shown in FIG. 1 for stretching and holding the workpiece cloth W to be sewn.

The cloth holding device 30 includes a support frame 31 made of a magnetic material having a thickness of approximately 1 mm and a presser frame 32 made of synthetic resin also having a thickness of approximately 1 mm. The workpiece cloth W is clamped between the support frame 31 and the presser frame 32. The support frame 31 assumes the same construction as the support frame 11 in the first embodiment, including a connection piece 31*a* having formed thereto a pair of connection hole 31*b*. The presser frame 32 has a vertical cross-section exhibiting a reversed U-shape, and the workpiece cloth W is pressed against the support frame 31 at the distal end portions of the opened side (underside). The support frame 31 has center line indicators 31*c* and 31*d*, indicating the two intersecting center lines, formed thereto and the presser frame 32 also has center line indicators 32*a* and 32*b*, indicating the two intersecting center lines, formed thereto.

Also, a plurality (eight, for example) of magnets 33 and a plurality (eight, for example) of magnet holding members 34 made of synthetic resin are attached to the presser frame 32. The plurality of magnets 33 are respectively supported by the plurality of magnet holding members 34. The magnets 33 are formed as a short cylinder, and the diameter thereof is approximately ½ of the width of each support piece of the support frame 31. The plurality of magnets 33 are disposed in appropriate positions in the interior of the presser frame 32 so as to allow the workpiece cloth W to be evenly pressed to the support frame 31 by the magnetic force of the magnets 33. The magnet holding member 34 holds the magnet 33 fitted therein in such a way that the distal end of the magnet 33 projects approximately 1 mm therefrom; and also, a guide pin 34*a* that extends toward the opposite side relative to the magnet 33 side is integrally formed in the base end of the magnet holding member 34.

On an upper wall of the presser frame 32, a plurality (eight, for example) of holes is defined in the positions corresponding to the plurality of magnets 33, the hole constituting a guide portion 32*c*. A guide pin 34*a* of the magnet holding member 34 is slidably inserted into the guide portions 32*c*. An operating portion 34*b* is connected to the guide pin 34*a*, more specifically on a distal end of the guide pin 34*a* that projects outside the presser frame 32 from the guide portion 32*c*. The magnet holding member 34 and the magnet 33 are guided in a direction (vertical) intersecting the support surface 31*e* by the guide pin 34*a* sliding inside the guide portion 32*c*. By a pushing/pulling the operating portion 34*b*, the magnet holding member 34 and the magnet 33 are switched between the attached position shown in FIG. 17 and the detached position shown in FIG. 18. When the magnet 33 is in the attached position, the magnet 33 is attached to the support frame 31, and when the magnet 33 is in the detached position, the magnet 33 is separated from the support frame 31. The magnet holding member 34 slidably contacts the inner surface of the presser surface 32 and the magnet holding member 34 is retained in the attached position by the frictional force exerted between the inner surface of the presser frame 32 and the magnet holding member 34. The guide member 32*c* and the operating portion 34*b* constitute a magnet position switch unit 35.

Also, the magnet 33 and the magnet holding member 34 are retained in the detached position by a detached position retaining unit 36. The detached position retaining unit 36 is disposed in a position (upper portion) corresponding to each magnet 33; secured to the inner surface of the upper wall of the presser frame 32; and provided with a plate-form member 37 made of magnetic material having a thickness of approximately 1 mm disposed so as not to interfere with the guide pin 34*a*. When the magnet 33 is switched to the detached position shown in FIG. 18, the magnetic attraction of the magnet 33 is exerted on the plate-form member 37 over the magnet holding member 34 and the magnet 33 is retained in the detached position by the magnetic attraction. Even in case the magnet 33 provides relatively strong magnetic force, suitable magnitude of retention can be obtained since the magnetic attraction is exerted on the plate-form member 37 over the magnet holding member 34.

According to the cloth holding device 30, when holding the workpiece cloth W, the workpiece cloth W is placed on the support frame 31 and the presser frame 32 is placed on the support frame 31 so as to clamp the workpiece cloth W therebetween. When the magnet 33 is switched from the detached position to the attached position from such state by the magnet position switch unit 35, the magnet 33 is attached to the support frame 31. Thus, the workpiece cloth W is pressed against the support frame 31 by the magnet 33 and the presser frame 32, thereby holding the workpiece cloth W with sufficient pressure applied thereupon.

In attaching the plurality of magnets 33 to the support frame 31 by switching the magnets 33 from the detached position to the attached position, as described in the first embodiment, the hold of the workpiece cloth W is established in a step-by-step manner by performing an operation of stretching and positioning the workpiece cloth W and by switching a part of the magnets 33 to the detached position and switching the same back to the attached position in order to further stretch and rearrange the positioning of the work piece cloth W.

Also, since the magnet position switch unit 35 includes a guide portion 32*c* and the operating portion 34*b*, each magnet 33 can be easily switched from the attached position and the detached position by operation of the operating portion 34*b*.

Furthermore, since the magnets 33 and the magnet holding members 34 are in consistently mounted on the presser frame 32, the possibility of losing the magnets 33 and the magnet holding members 34 are eliminated. Other operation and effect of the present embodiment is the same as the foregoing embodiments.

Fourth Embodiment

FIGS. 19 to 22 indicate a fourth embodiment. A cloth holding device 40 of the fourth embodiment is attached to the embroidery sewing machine 1 of the type shown in FIG. 1 or the ink-jet printer described in the second embodiment.

The cloth holding device 40 includes a substantially flat plate-form support member 41 made of synthetic resin and a presser frame 42 made of a magnetic material having a thickness of approximately 1 mm. The workpiece cloth W is clamped between the support member 41 and the presser frame 42. The support member 41 has center line indicators 41*a* and 41*b*, indicating the two intersecting center lines, formed thereto and the presser frame 42 also has center line indicators 42*a* and 42*b*, indicating the two intersecting center lines, formed thereto. When the presser frame 42 is centered and placed on the support member 41, the presser frame 42 is slightly projected outward relative to the support member 41. A frame portion 41*c* having a U-shape vertical surface is formed in the outer periphery portion of the support member 41; and the workpiece cloth W is pressed against the distal end portions of the opened side (upper side) thereof by the presser frame 42. The supporting member 41 of the frame portion 41*c* is substantially the same as the presser frame 32 in the third embodiment.

Also, a plurality of magnets 43 (four, for example) are held respectively by a plurality (four, for example) of magnet holding members 44 made of synthetic resin material. The plurality of magnets 43 are disposed in an appropriate position in the interior of the frame portion 41*c* of the support member 41 so as to allow the workpiece cloth W to be evenly pressed against the support member 41 by the magnetic attraction of the plurality of magnets 43. The manner of connection between the magnet 43 and the magnet holding member 44 is the same as the third embodiment.

A magnet position switch unit 45 is provided in the support member 41 and includes a guide portion 41*e* constituted by a hole (41*e*) that movably guides each magnet 43 in a direction (vertical direction) perpendicular to a support surface 41*d* of the support member 41; and an operating portion 44*b* secured to each magnet 43 and switching the magnet 43 between the attached position and the detached position by pushing/pulling the magnet 43 in the direction guided by the guide portion 41*e*. The position of each magnet 43 attached to the support member 41 is switched between the attached position in which the magnet 43 is attached to the presser frame 42, and the detached position in which the magnet 43 is moved away from the attached position. At this time, the magnet 43 and the magnet holding member 44 are retained in the detached position by a detached position retaining unit 46. The detached position retaining unit 46 has a plate-form member 47 made of magnetic material secured to the inner surface of the bottom wall of the frame portion 41*c* in a position corresponding to each magnet 43.

According to the cloth holding device 40, in holding the workpiece cloth W, the workpiece cloth W is placed on the support member 41 and the presser frame 42 is placed on the support frame 41 so as to clamp the workpiece cloth W therebetween. When the magnet 43 is switched from the detached position to the attached position from such state by the magnet position switch unit 45, the magnet 43 is attached to the presser frame 42. Thus, the workpiece cloth W is pressed against the support member 41 by the magnetic attraction of the plurality of magnets 43 and the workpiece cloth W can be held with sufficient pressure applied thereupon.

In attaching a plurality of magnets 43 to the presser frame 42 by switching the magnets 43 from the detached position to the attached position, as described in the third embodiment, the hold of the workpiece cloth W is established in a step-by-step manner by performing an operation of stretching and positioning the workpiece cloth W and by switching a part of the magnets 43 to the detached position and switching back the same to the detached position in order to further stretch and rearrange the positioning of the workpiece cloth W; thus, the workpiece cloth W can be stretched and held in the desired position with respect to the support member 41 with ease and high reliability. Other operation and effect is the same as the third embodiment.

Fifth Embodiment

FIGS. 23 to 29 indicate a fifth embodiment.

The cloth holding device 50 of the present embodiment is employed in the embroidery sewing machine 1 of the type shown in FIG. 1 to stretch and hold the workpiece cloth W to be sewn.

The cloth holding device 50 will be explained with reference to FIGS. 23 to 29. The cloth holding device 50 includes a support frame 51 made of a magnetic material having a thickness of approximately 1 mm and a presser frame 52 made of synthetic resin. The workpiece cloth W is clamped between the support frame 51 and the presser frame 52. The support frame 51 and the presser frame 52 assume the same construction as the support frame 31 and the presser frame 32 in the third embodiment, in which the support frame 51 is provided with a connection piece 51*a* having a pair of connection holes 51*b* defined therein; and the support frame 51 has center line indicators 51*c* and 51*d* formed thereto and the presser frame 52 also has center line indicators 52*a* and 52*b* formed thereto.

Figure 27:
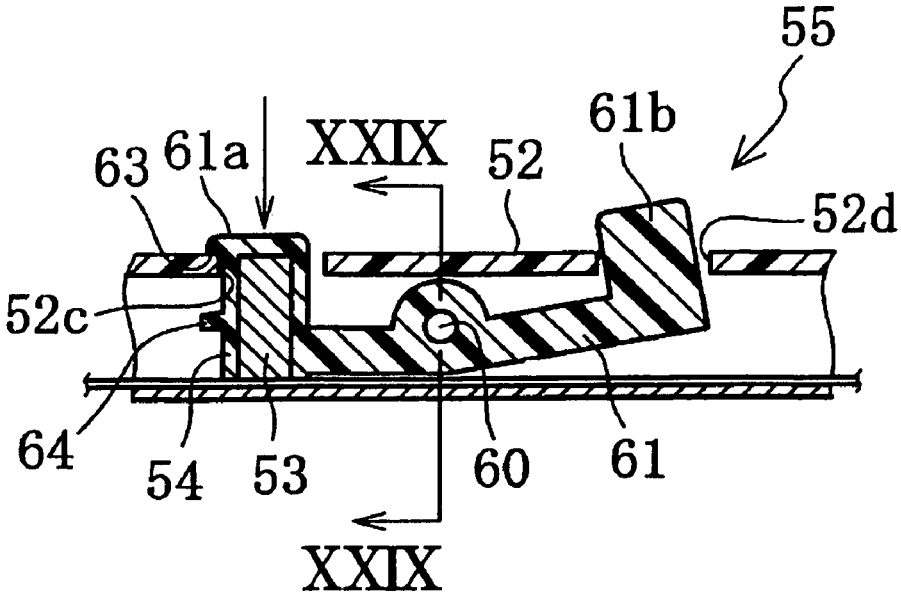
FIG. 27 is a section view taken along line 27-27 of a magnet attached state of FIG. 25.
Figure 28:
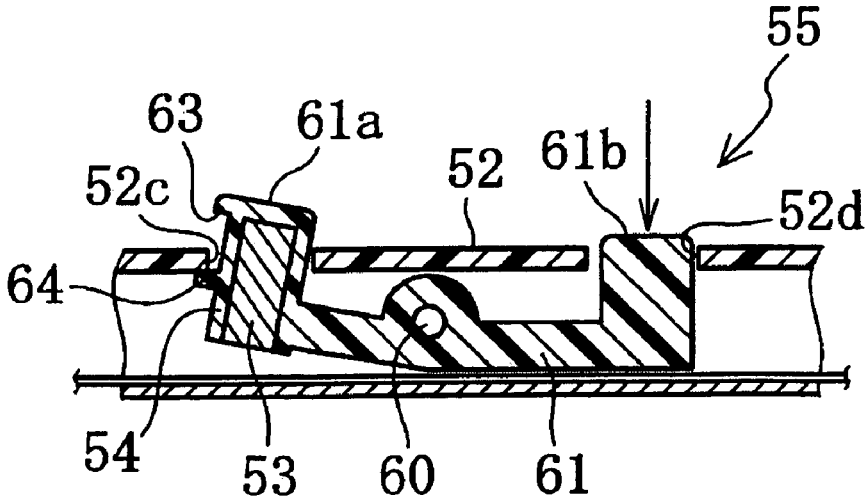
FIG. 28 corresponds to FIG. 27 in a magnet detached state.

Further, a plurality of (eight, for example) magnets 53 is respectively attached to the presser frame 52 by being held by a plurality (eight, for example) of magnet holding members 54 made of synthetic resin. The magnet 53 is formed as a slightly elongated cylinder, and the diameter thereof is approximately ½ of the width of each support piece of the support frame 51. The plurality of magnets 53 are disposed in appropriate positions in the interior of the presser frame 52 so as to allow the workpiece cloth W to be evenly pressed against the support frame 51 by the magnetic attraction of the plurality of magnets 53. The magnet holding member 54 has a magnet 53 fitted therein and the magnet 53 is held by the magnet holding member 54 such that the distal ends of the foregoing are coplanar. The plurality of magnet holding members 54 constitutes a part of the later described lever member 61. As shown in FIGS. 27 to 28, the magnet holding member 54 in one end of the lever member 61 has a first engagement portion 63 engaging with the upper wall of the presser frame 52 from the exterior, and a second engagement portion 64 engaging with the upper wall of the presser frame 52 from the interior.

A magnet position switch unit 55 will be described herein after. The lever member 61 has the lengthwise mid-portion thereof supported rotatably by the presser frame 52 by a pivot pin 60; and the magnet holding member 54 having the magnet 53 connected thereto is provided on one end of the lever member 61. Furthermore, the lever member 61 has operating portions 61*a* and 61*b* on both ends thereof that switch the magnet 53 between the attached position shown in FIG. 27 and the detached position shown in FIG. 28 by the rotation of the lever member 61. The lever member 61 is situated in the interior of the presser frame 52. Also, the upper wall of the presser frame 52 has a pair of holes 52*c* and 52*d* defined thereto so as to correspond to each magnet 53 and the lever member 61; and the operating portions 61*a* and 61*b* are projectable to the exterior through the holes 52*c* and 52*d*. Therefore, when the magnet 53 is in the attached position, the operating portion 61*b* projects to the exterior and when the magnet 53 is in the detached position, the operating portion 61*a* projects to the exterior.

The position of each magnet 53 attached to the presser frame 52 is switched between the attached position in which the magnet 53 is attached to the support frame 51 as shown in FIG. 27 and the detached position moved away from the attached position as shown in FIG. 28 by the magnet position switch unit 55. When the operating portion 61*a* is pressed with the magnet 53 in the detached position, the magnet 53 is thereby switched to the attached position, and when the operating portion 61*b* is pressed with the magnet 53 in the attached position, the magnet 53 is thereby switched to the detached position. At this time, each magnet 53 and the magnet holding member 54 are retained in the detached position by a detached position retaining unit 56.

Figure 29:
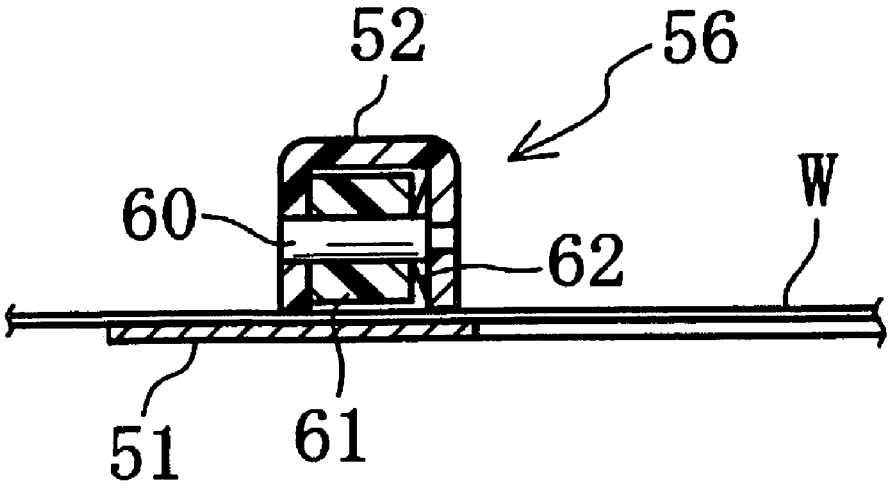
FIG. 29 is a section view taken along line 29-29 in FIG. 27.

The detached position retaining unit 56, as shown in FIG. 29, includes a conical spring 62 disposed about a pivot pin 60 in the interior of the presser frame 52. The lever member 61 is pressed against the inner surface of the presser frame 52 by the elasticity of the conical spring 62, thereby exerting frictional force between the lever member 61 and the presser frame 52. Thus, the rotation of the lever member 61 is sustained and the magnet 53 is retained in the detached position.

According to the cloth holding device 50, in holding the workpiece cloth W, the workpiece cloth W is placed on the support frame 51 and the presser frame 52 is placed on the support frame 51 so as to clamp the workpiece cloth therebetween. In such state, when the magnet 53 is switched from the detached position to the attached position by the magnet position switch unit 55, the magnet 53 is attached to the support frame 51. The first engagement portion 63 on one end of the lever member 61 of the magnet holding member 54 engages with the upper wall of the presser frame 52 from the exterior, and a second engagement portion 64 engages with the upper wall of the presser frame 52 from the interior. Therefore, the magnet holding member 54 of the magnet 53 attached to the support frame 51 presses the presser frame 52 against the support frame 51 via the first engagement portion 63. Also, the magnet 53 assumes the detached position by the engagement of the second engagement portion 64 with the upper wall of the presser frame 51; and the lever member 61 being arranged so as not to project below the presser frame 52 prevents further rotation of the lever member 61 in the clockwise direction as viewed in FIG. 28; thus, when holding the workpiece cloth W, the presser frame 52 can be placed stably on the support frame 51 over the workpiece cloth W.

In attaching the plurality of magnets 53 to the support frame 51 by switching the magnets 53 from the detached position to the attached position, the hold of the workpiece cloth W is established in a step-by-step manner by performing an operation of stretching and positioning the workpiece cloth and by switching a part of the magnets 53 to the detached position and switching back the same to the attached position in order to further stretch and rearrange the positioning of the workpiece cloth W.

Since the magnet position switch unit 55 includes a lever member 61 and operating portions 61*a* and 61*b*, by operating the operating portions 61*a* and 61*b* provided on both ends of the lever member 61, the lever member 61 is rotated and each magnet 53 connected to one end of the lever member 61 can be switched between the attached position and the detached position.

The present invention is not limited to the above described embodiments but may be modified as follows.

Figure 30:
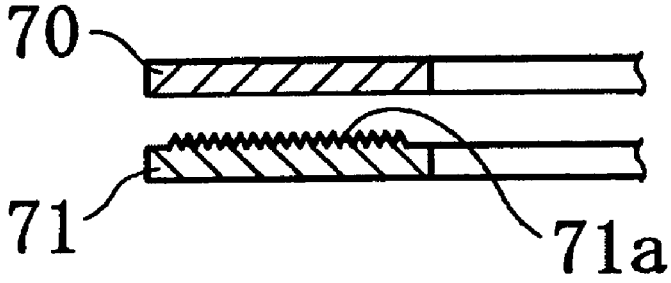
FIG. 30 is a vertical section view of a modified support frame and a presser frame.
Figure 31:
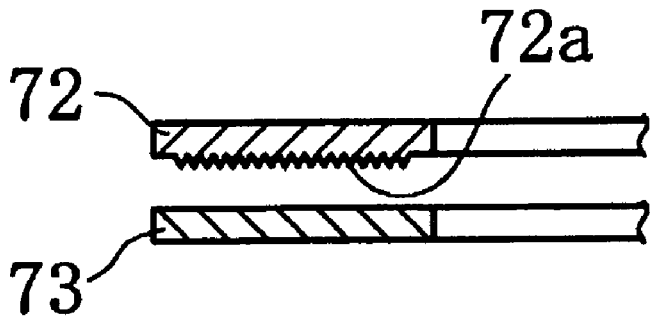
FIG. 31 is a vertical section view of another modified support frame and a presser frame.
Figure 32:
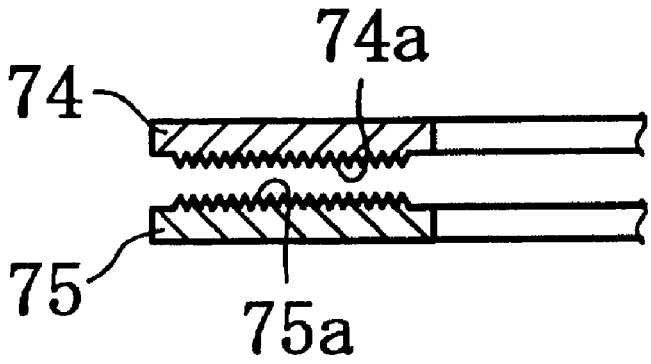
FIG. 32 is a vertical section view of yet another modified support frame and a presser frame.

In the first to fifth embodiments, the support frame and the presser frame may be modified as follows. The support member which will not be described may be modified in the same way as the presser frame. As shown in FIG. 30, an anti-slip portion 71*a* may be defined on a portion of a support frame 71 confronting the presser frame 70. As shown in FIG. 31, an anti-slip portion 72*a* is defined on a portion of the presser frame 72 confronting the support frame 73. As shown in FIG. 32, on the portion of the presser frame 74 confronting the support frame 75 and on the portion of the support frame 75 confronting the presser frame 74, anti-slip portions 74*a* and 75*a* are formed respectively. The anti-slip portions 71*a*, 72*a*, 74*a*, and 75*a* comprise a plurality of small projections and recesses. Thus, the workpiece cloth pressed against the support frames 71, 73 and 75 by the presser frames 70, 72, and 74 is made less slippery by the anti-slip portions, and the workpiece cloth can be stretched and held more reliably in the desired positioning with respect to the support frames 71, 73, and 75.

The magnet holding member made of synthetic resin in the above first to fifth embodiment may be made of magnetic material, for example, steel. In such case, the magnet holding member serves as a yoke that constitutes a magnetic circuit, thereby increasing the magnetic force and allowing a the workpiece cloth W to be held reliably.

The attachment unit may be constructed solely of a magnet in the above first to fifth embodiments. In such case, the magnet is formed in a cylindrical form having a projection of approximately 1 mm in the distal end thereof so that the projection engages with the engagement hole.

Figure 33:
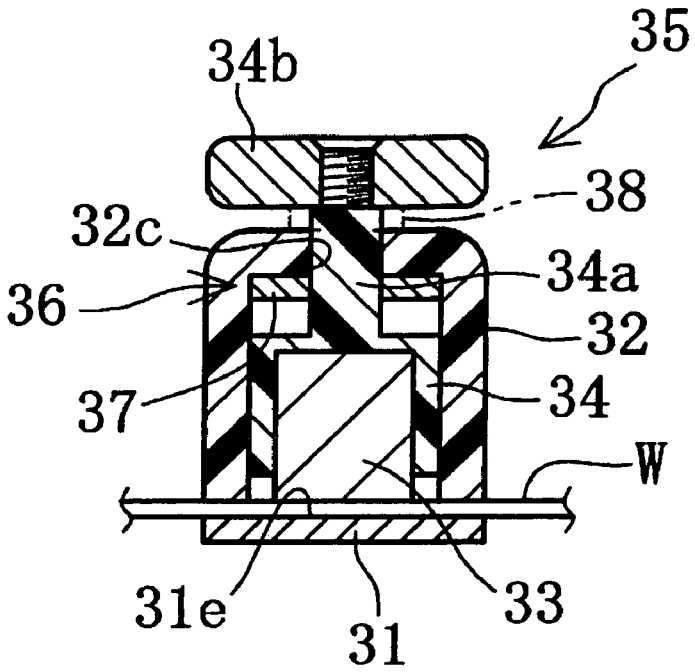
FIG. 33 corresponds to FIG. 17 and indicates a modification thereof.
Figure 34:
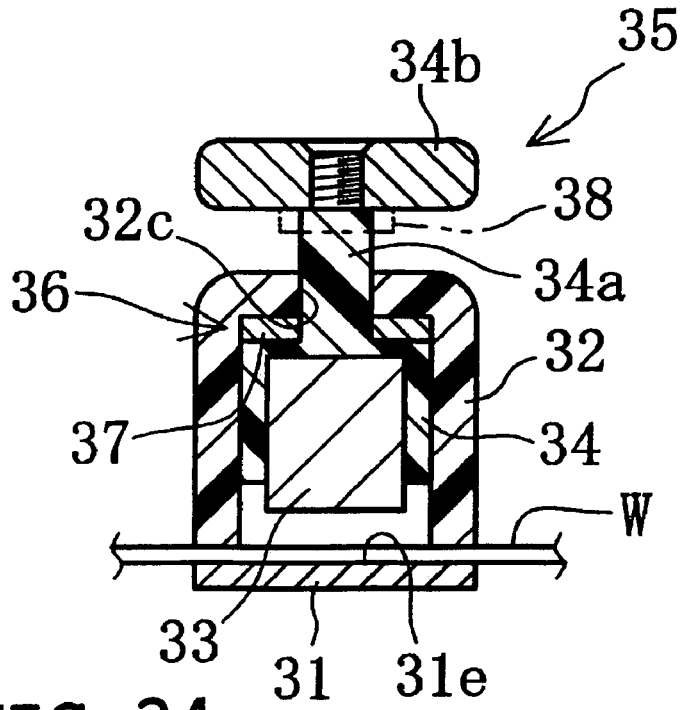
FIG. 34 corresponds to FIG. 18 and indicates a modification thereof.

In the above third embodiment, in case a spacer 38 is disposed between the operating portion 34*b* and the presser frame 32, by being provided integrally with the magnet holding member 34 (refer to FIGS. 33 and 34), the magnet holding member 34 of the magnet 33 attached to the support frame 31 presses the presser frame 32 against the support frame 31 via the spacer 38. That is, the magnetic force of the magnet 33 to attract the support frame 31 is conveyed to the presser frame 32 from the magnet holding member 34, allowing the presser frame 32 to be pressed against the support frame 31 in the proximity of the magnet 33.

In the first embodiment, the cloth holding device 10 may be partially modified as follows. 1] The shape and size of the support frame 11 and the presser frame 12; the shape, size and number of the magnet 13, the magnet holding member 14, and the engagement hole 12*c*; the arrangement of the plurality of magnets 13 and the engagement holes 12*c*; the magnetic force of the magnet 13, and the like may be changed as appropriate. 2] The magnet holding member 14 may be omitted, and the operating portion may be provided in the magnet 13. 3] The magnet 13 positioned to the presser frame 12 by the magnet positioning unit may be alternatively arranged to be attached to the support frame 11 by being placed in the outer side or the inner side relative to the presser frame 12.

Therefore, the cloth holding device 10 can be applied to the embroidery sewing machine as a device that holds the workpiece cloth to be sewn, thereby enabling the improvement of sewing and sewing position accuracy, and reduction of sewing sequence duration.

In the above second embodiment, the above described partial modification may also be made to the cloth holding device 20. Also, the support member may take on a frame-form having a substantially same shape and size as the presser frame 22.

In the third embodiment, the cloth holding device 30 may also be partially modified as follows. 1] The shape and size of the support frame 31 and the presser frame 32; the shape, size and number of the magnet 33 and the magnet holding member 34; the arrangement and the magnetic force of the plurality of magnets 33, and the like, may be changed as appropriate. 2] The detached position retaining unit 36 comprising a plate-form member 37 may alternatively employ various arrangements such providing an engagement subject on the magnet holding member 34 that engages with an engagement portion provided on the presser frame 32 to retain the magnet 33 in the detached position; or simply retaining the magnet in the detached position by the frictional force exerted between the magnet holding member 34 and the inner surface of the presser frame 32 contacting the magnet holding member 34.

In the fourth embodiment, partial modifications as described above may be made to the cloth holding device 40 as well. Also, the support member may be shaped in a frame-form having a substantially same size as the presser frame 42.

In the fifth embodiment, partial modification may be made to the cloth holding device 50 as well. 1] The shape and size of the support frame 51 and the presser frame 52; the shape, size and number of the magnet 53 and the lever member 61 (magnet holding member 54); the arrangement and the magnetic force of the magnet 53, or the like, may be changed as appropriate. 2] The detached position retaining unit 56 may alternatively employ various types of biasing members other than the conical spring 62 such as a compression coil spring; and instead of providing the conical spring 62, the magnet 53 may be simply retained in the detached position by the frictional force exerted between the magnet holding member 54 and the inner surface of the presser frame 52 contacting the magnet holding member 54.

INDUSTRIAL APPLICABILITY

As described above, the cloth holding device of the present invention is useful as an embroidery frame of an embroidery sewing machine or a cloth holding device for printers that print the workpiece cloth.

The invention claimed is:

1. A cloth holding device including a support frame made of magnetic material and a presser frame, clamping a workpiece cloth therebetween, the cloth holding device comprising:

an attachment unit provided on the presser frame and that presses the presser frame against the support frame by a magnetic attraction exerted between the support frame and the presser frame; and a positioning unit that positions the attachment unit to the presser frame;

wherein the attachment unit is detachable from a presser frame surface opposite a surface pressing the workpiece cloth.

2. The cloth holding device according to claim 1, wherein the positioning unit includes an engagement hole defined for an engagement with the attachment unit.

3. The cloth holding device according to claim 1, wherein the attachment unit further comprises a plurality of magnets and a plurality of magnet holding members that hold the plurality of magnets, and the presser frame is pressed against the support frame by the magnet holding members when the magnets are attached to the support frame.

4. The cloth holding device according to claim 3, wherein the magnet holding member is made of a magnetic material.

5. The cloth holding device according to claim 1, wherein at least a confronting portion of either the support frame or the presser frame is provided with anti-slip portions.

6. A cloth holding device including a support frame made of magnetic material and a presser frame, clamping a workpiece cloth therebetween, the cloth holding device comprising:

an attachment unit provided in the presser frame and movable between an attached position proximate the support frame and a detached position spaced from the support frame; and a switch unit that switches the attachment unit between the attached position and the detached position, wherein the attachment unit when in the attached position presses the presser frame against the support frame by a magnetic attraction exerted between the support frame and the presser frame, the attachment unit further comprises:

a plurality of magnets, and a plurality of magnet holding members that hold the plurality of magnets, and the presser frame is pressed against the support frame by the magnet holding members when the magnets are attached to the support frame.

7. The cloth holding device according to claim 6, wherein the support frame includes a support surface supporting the workpiece cloth, the switch unit includes a guide portion provided in the presser frame and movably guiding the attachment unit in a direction perpendicular to the support surface, and an operating portion provided in the attachment unit switches the attachment unit between the attached position and the detached position by a pushing/pulling operation.

8. The cloth holding device according to claim 6, wherein the switch unit further comprises a lever member including:

a lengthwise mid-portion supported rotatably by the presser frame and having one end connected to the attachment unit, and a pair of operating portions provided on both ends of the lever member, and a pressing operation of the switch unit effects rotation of the lever member to switch the attachment unit between the attached position and the detached position.

9. The cloth holding device according to claim 6, wherein at least a confronting portion of either the support frame or the presser frame is provided with anti-slip portions.

10. The cloth holding device according to claim 6, wherein the magnet holding member is made of a magnetic material.

11. A cloth holding device including a plate-form or a frame-form support member made of magnetic material and a presser frame, clamping a workpiece cloth therebetween, the cloth holding device comprising:

an attachment unit provided on the support member and that presses the presser frame against the support member by a magnetic attraction exerted between the support member and the presser frame; and a positioning unit that positions the attachment unit to the support member;

wherein the attachment unit is detachable from a support member surface opposite a surface pressing the workpiece cloth.

12. A cloth holding device including a plate-form or a frame-form support member made of magnetic material and a presser frame, clamping a workpiece cloth therebetween, the cloth holding device comprising:

an attachment unit provided in the support member and movable between an attached position proximate the presser frame and a detached position spaced from the support frame; and a switch unit that switches a position of the attachment unit between the attached position and the detached position, wherein the attachment unit when in the attached position presses the support member against the presser frame by a magnetic attraction exerted between the support member and the presser frame, the attachment unit further comprises:

a plurality of magnets, and a plurality of magnet holding members that hold the plurality of magnets, and the presser frame is pressed against the support frame by the magnet holding members when the magnets are attached to the support frame.

* * * * *